US008739366B2

(12) United States Patent
Heninger

(10) Patent No.: US 8,739,366 B2
(45) Date of Patent: Jun. 3, 2014

(54) HINGE-INTEGRATED ADJUSTABLE DOOR STOP

(76) Inventor: Brent Heninger, Sandy, UT (US)

( * ) Notice: Subject to any disclaimer, the term of this patent is extended or adjusted under 35 U.S.C. 154(b) by 0 days.

(21) Appl. No.: 13/513,265

(22) PCT Filed: Dec. 2, 2010

(86) PCT No.: PCT/US2010/058777

§ 371 (c)(1),
(2), (4) Date: Jun. 1, 2012

(87) PCT Pub. No.: WO2011/069001

PCT Pub. Date: Jun. 9, 2011

(65) Prior Publication Data

US 2012/0240354 A1 Sep. 27, 2012

Related U.S. Application Data

(60) Provisional application No. 61/266,065, filed on Dec. 2, 2009, provisional application No. 61/292,373, filed on Jan. 5, 2010.

(51) Int. Cl.
*E05D 11/06* (2006.01)
*E05D 11/00* (2006.01)
*E05D 5/00* (2006.01)

(52) U.S. Cl.
USPC ..... 16/374; 16/386; 16/381

(58) Field of Classification Search
USPC ..... 16/374, 380, 381, 386, 387, 363
See application file for complete search history.

(56) References Cited

U.S. PATENT DOCUMENTS

| | | | | | |
|---|---|---|---|---|---|
| 353,007 | A | * | 11/1886 | Schubert et al. | 16/381 |
| 737,360 | A | * | 8/1903 | Daly | 403/154 |
| 1,030,801 | A | * | 6/1912 | Berault | 16/262 |
| 1,292,801 | A | * | 1/1919 | Keogh | 278/96 |
| 1,837,204 | A | * | 12/1931 | Chester | 16/343 |
| 2,978,736 | A | * | 4/1961 | Welker | 16/380 |
| 2,993,226 | A | * | 7/1961 | Baker, Jr. et al. | 16/375 |
| 3,015,126 | A | * | 1/1962 | Ahlgren | 16/386 |

(Continued)

FOREIGN PATENT DOCUMENTS

| | | | |
|---|---|---|---|
| DE | 2520305 | A * | 11/1976 |
| DE | 3215569 | A1 * | 10/1983 |

OTHER PUBLICATIONS

DE 2520305 A—Description Machine Translation.*

*Primary Examiner* — Victor Batson
*Assistant Examiner* — Jason W San
(74) *Attorney, Agent, or Firm* — Michael F. Krieger; Kirton McConkie

(57) ABSTRACT

A hinge has a hinge-integrated stop. The hinge includes a first hinge leaf having a substantially-planar portion with a pivot edge and a top edge. The first hinge leaf includes a first knuckle extending from the pivot edge of the substantially-planar portion near the top edge. The first knuckle of the first leaf includes an inner splined surface. The hinge also includes a second hinge leaf having a substantially-planar portion having a pivot edge. A first knuckle extends from the pivot edge of the substantially-planar portion of the second hinge leaf, where the first knuckle has an inner surface and a first knuckle stop element on the inner surface. A hinge pin has a shaft having a shaft diameter and an upper splined portion having fingers extending beyond the shaft diameter and a hinge pin stop element located on the shaft below the upper splined portion.

20 Claims, 23 Drawing Sheets

(56) References Cited

U.S. PATENT DOCUMENTS

| | | | | | |
|---|---|---|---|---|---|
| 3,068,508 | A | * | 12/1962 | Heyer | 16/386 |
| 3,188,686 | A | * | 6/1965 | Orcutt | 16/263 |
| 3,209,391 | A | * | 10/1965 | Mangini | 16/300 |
| 3,232,160 | A | * | 2/1966 | Fork et al. | 411/479 |
| 3,538,539 | A | * | 11/1970 | Allison | 16/375 |
| 3,621,512 | A | * | 11/1971 | Johnson | 16/380 |
| 3,962,750 | A | * | 6/1976 | Buss et al. | 16/381 |
| 3,971,099 | A | * | 7/1976 | Wallace | 16/50 |
| 4,073,037 | A | * | 2/1978 | Curry et al. | 16/304 |
| 4,345,848 | A | * | 8/1982 | Cheselka | 403/157 |
| 4,475,266 | A | * | 10/1984 | Suska | 16/273 |
| 4,675,940 | A | * | 6/1987 | Brockhaus | 16/273 |
| 4,697,306 | A | * | 10/1987 | Rhodes | 16/317 |
| 5,191,678 | A | * | 3/1993 | Firari | 16/305 |
| 5,577,295 | A | * | 11/1996 | Papke et al. | 16/254 |
| 5,727,289 | A | * | 3/1998 | Reder | 16/375 |
| 5,884,365 | A | * | 3/1999 | Kluting | 16/257 |
| 6,178,599 | B1 | * | 1/2001 | Worden et al. | 16/386 |
| 6,317,928 | B1 | * | 11/2001 | Guillemette | 16/353 |
| 7,197,791 | B1 | * | 4/2007 | Smith | 16/375 |
| 7,703,577 | B1 | * | 4/2010 | Zach et al. | 184/6.19 |
| 7,861,379 | B2 | * | 1/2011 | Peters et al. | 16/375 |
| 8,060,985 | B2 | * | 11/2011 | Lin | 16/374 |
| 8,099,834 | B2 | * | 1/2012 | Corso et al. | 16/374 |
| 8,156,613 | B2 | * | 4/2012 | Smith | 16/375 |
| 8,191,205 | B2 | * | 6/2012 | Forrest | 16/273 |
| 8,307,513 | B1 | * | 11/2012 | Fitzgerald | 16/386 |
| 8,327,505 | B2 | * | 12/2012 | Smith | 16/375 |
| 8,359,709 | B2 | * | 1/2013 | Van Gennep | 16/328 |
| 2002/0078529 | A1 | * | 6/2002 | Schwarz | 16/387 |
| 2008/0115328 | A1 | * | 5/2008 | Tomaini et al. | 16/386 |
| 2009/0151124 | A1 | * | 6/2009 | Forrest | 16/374 |
| 2010/0251520 | A1 | * | 10/2010 | Corso et al. | 16/342 |
| 2012/0117760 | A1 | * | 5/2012 | Corso et al. | 16/374 |
| 2012/0240354 | A1 | * | 9/2012 | Heninger | 16/374 |
| 2012/0272477 | A1 | * | 11/2012 | Mirick | 16/274 |
| 2013/0021726 | A1 | * | 1/2013 | Yang et al. | 361/679.01 |

* cited by examiner

HINGE-INTEGRATED ADJUSTABLE DOOR STOP

TECHNICAL FIELD

The present invention relates to door stop mechanisms, and more particularly to hinge-integrated adjustable door stops.

BACKGROUND ART

A variety of mechanisms are currently used to act as door stops to stop motion of a door at a desired location, with a variety of problems. Some door stops mount to an adjacent wall and are designed to impact a portion of the door or door handle to stop motion of the door. Such door stops have several problems. They are limited in that they are generally only able to stop the door at a single location. Additionally, they are an additional component to the door system, increasing costs and possible failures. When the door is not engaged to such door stops, they protrude from the wall where they can be in the way (such as for vacuuming or other cleaning) and are visually unappealing. Finally, it is possible for such systems to result in holes and/or dents in the door and/or wall.

Alternatively, similar door stops are attached to the doors and stop the doors by a portion of the door stop striking a wall structure, commonly the base board or other structure on the wall. Such systems have many of the same problems as the wall-mounted stops. If the location of striking the wall is insufficiently reinforced or the door stop is poorly placed, the result may be a hole or holes in the wall. These systems also mar the appearance of the door and provide only minimal or no adjustability of the location of stopping the door. As a separate component, they also add costs to a door system.

Other door stops are floor-mounted. While such stops provide much better adjustability of the location of stopping the door, these stops also have significant problems. Such door stops are commonly located well out from the wall and are therefore a significant trip hazard. Additionally, the stops may require some integration with existing flooring, and once placed are not easy to change the location of stopping the door, as it may be necessary to repair the floor at the original location. These door stops also add costs to a door system.

Still other stops are hinge mounted. One commonly-used hinge-mounted door stop is of the type shown in U.S. Pat. No. 3,913,717, and utilizes a pair of arms mounted on top of the hinge pin to impact the door and the casing around the door. While such systems are more-easily adjustable than other systems, they still have significant problems. Such systems are visually unappealing, and commonly result in holes in many doors, such as hollow-core doors. Other door stop systems have similar problems to those discussed above.

SUMMARY OF THE INVENTION

Implementation of the invention provides a hinge, such as a hinge for a door, having a hinge-integrated stop. The hinge includes a first hinge leaf with a substantially-planar portion and a knuckle and a second hinge leaf with a substantially-planar portion and a knuckle. The hinge also includes a hinge pin and a door stop element. When the hinge is assembled with the hinge pin passing through the knuckles of the first hinge leaf and the second hinge leaf, the door stop element is hidden within the knuckles.

Further implementation of the invention provides a hinge, such as a hinge for a door, having a hinge-integrated stop. The hinge includes a first hinge leaf having a substantially-planar portion with a pivot edge and a top edge. The first hinge leaf includes at least a first knuckle extending from the pivot edge of the substantially-planar portion of the first hinge leaf near the top edge. The first knuckle of the first leaf includes an inner splined surface.

The hinge also includes a second hinge leaf having a substantially-planar portion having a pivot edge. The second hinge leaf also includes a first knuckle extending from the pivot edge of the substantially-planar portion of the second hinge leaf, where the first knuckle has an inner surface and a first knuckle stop element on the inner surface.

A hinge pin completes the hinge. The hinge pin has a shaft having a shaft diameter and an upper splined portion having fingers extending beyond the shaft diameter and a hinge pin stop element located on the shaft below the upper splined portion.

One manner by which the hinge is assembled and the stop position chosen is by attaching the first hinge leaf to one of a door and a door frame, attaching the second hinge leaf to the other of the door and the door frame at a position corresponding to a location of the first hinge leaf, and positioning the door proximate the door frame such that the first knuckle of the first hinge leaf is substantially aligned over the first knuckle of the second hinge leaf. The hinge pin is inserted through the first knuckle of the first hinge leaf and the second knuckle of the second hinge leaf until the upper splined portion of the hinge pin is located just above the inner splined surface of the first knuckle of the first hinge leaf. Then the hinge pin is rotated with respect to the first hinge leaf to a position defining a stop position for the door and is then fully inserted, whereby the upper splined portion of the hinge pin engages the inner splined surface of the first knuckle of the first hinge leaf. This engagement prevents rotation of the hinge pin with respect to the first hinge leaf.

The hinge-integrated stop serves to stop the door at a desired position. As the door is opened or otherwise rotated around the hinge axis, the first knuckle stop element engages the hinge pin stop element, stopping rotational motion of the second hinge leaf with respect to the hinge pin and the first hinge leaf, stopping motion of the door at the desired position.

BRIEF DESCRIPTION OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

Figure 1:
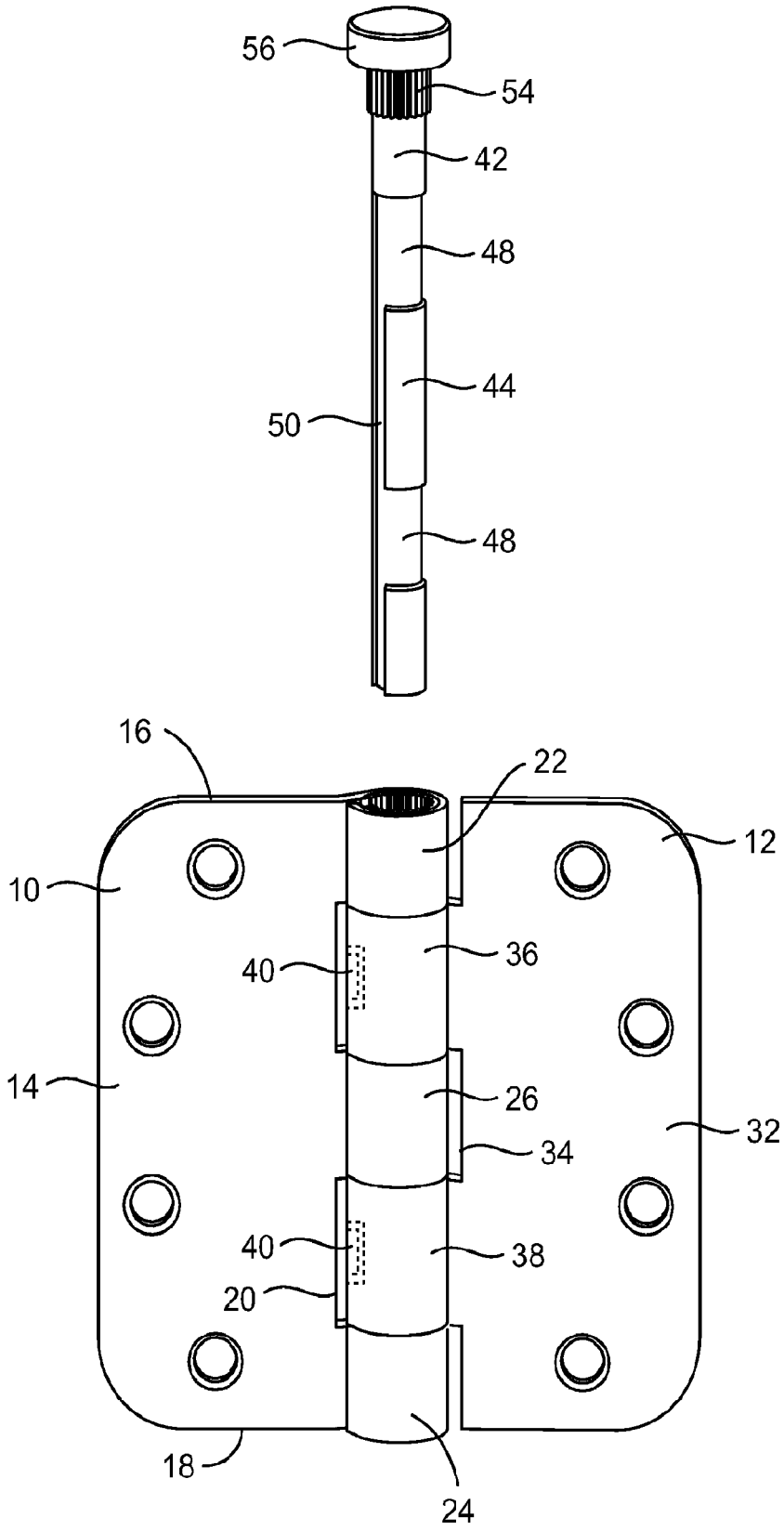
FIG. 1 shows a view of one embodiment of a hinge with a hinge pin removed for illustration purposes.

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

Embodiments of the invention provide a hinge, such as a hinge for a door, having a hinge-integrated stop. The hinge includes a first hinge leaf with a substantially-planar portion and a knuckle and a second hinge leaf with a substantially-planar portion and a knuckle. The hinge also includes a hinge pin and a door stop element. When the hinge is assembled with the hinge pin passing through the knuckles of the first hinge leaf and the second hinge leaf, the door stop element is hidden within the knuckles.

Further embodiments of the invention provide a hinge, such as a hinge for a door, having a hinge-integrated stop. The hinge includes a first hinge leaf having a substantially-planar portion with a pivot edge and a top edge. The first hinge leaf includes at least a first knuckle extending from the pivot edge of the substantially-planar portion of the first hinge leaf near the top edge. The first knuckle of the first leaf includes an inner splined surface.

The hinge also includes a second hinge leaf having a substantially-planar portion having a pivot edge. The second hinge leaf also includes a first knuckle extending from the pivot edge of the substantially-planar portion of the second hinge leaf, where the first knuckle has an inner surface and a first knuckle stop element on the inner surface.

A hinge pin completes the hinge. The hinge pin has a shaft having a shaft diameter and an upper splined portion having fingers extending beyond the shaft diameter and a hinge pin stop element located on the shaft below the upper splined portion.

One manner by which the hinge is assembled and the stop position chosen is by attaching the first hinge leaf to one of a door and a door frame, attaching the second hinge leaf to the other of the door and the door frame at a position corresponding to a location of the first hinge leaf, and positioning the door proximate the door frame such that the first knuckle of the first hinge leaf is substantially aligned over the first knuckle of the second hinge leaf. The hinge pin is inserted through the first knuckle of the first hinge leaf and the second knuckle of the second hinge leaf until the upper splined portion of the hinge pin is located just above the inner splined surface of the first knuckle of the first hinge leaf. Then the hinge pin is rotated with respect to the first hinge leaf to a position defining a stop position for the door and is then fully inserted, whereby the upper splined portion of the hinge pin engages the inner splined surface of the first knuckle of the first hinge leaf. This engagement prevents rotation of the hinge pin with respect to the first hinge leaf.

The hinge-integrated stop serves to stop the door at a desired position. As the door is opened or otherwise rotated around the hinge axis, the first knuckle stop element engages the hinge pin stop element, stopping rotational motion of the second hinge leaf with respect to the hinge pin and the first hinge leaf, stopping motion of the door at the desired position.

In the description, embodiments of hinges are described with respect to a door hinge for providing hinged movement around a substantially-vertical axis to a door. As such, references in the description and in the claims to "vertical" should be understood to refer to refer to a direction substantially parallel to a rotational axis of the hinge, as door hinges are commonly used with axes of rotation that are substantially vertical. Thus, "vertical" as used herein, when referring to hinges where the axis of rotation is horizontal or any other orientation, should be understood as being roughly parallel to the longitudinal axis of the hinge pin.

FIG. 1 shows a first embodiment of a hinge. The hinge includes a first hinge leaf 10 and a second hinge leaf 12. The first hinge leaf 10 includes a substantially-planar portion 14 which has a top edge 16, a bottom edge 18, and a pivot edge 20. The pivot edge 20 is the edge of the substantially-planar portion 14 adjacent to or closest to the axis of rotation of the first hinge leaf 10 with respect to the second hinge leaf 12. A first knuckle 22 extends from the pivot edge 20 near the top edge 16 of the substantially-planar portion 14.

Figure 2:
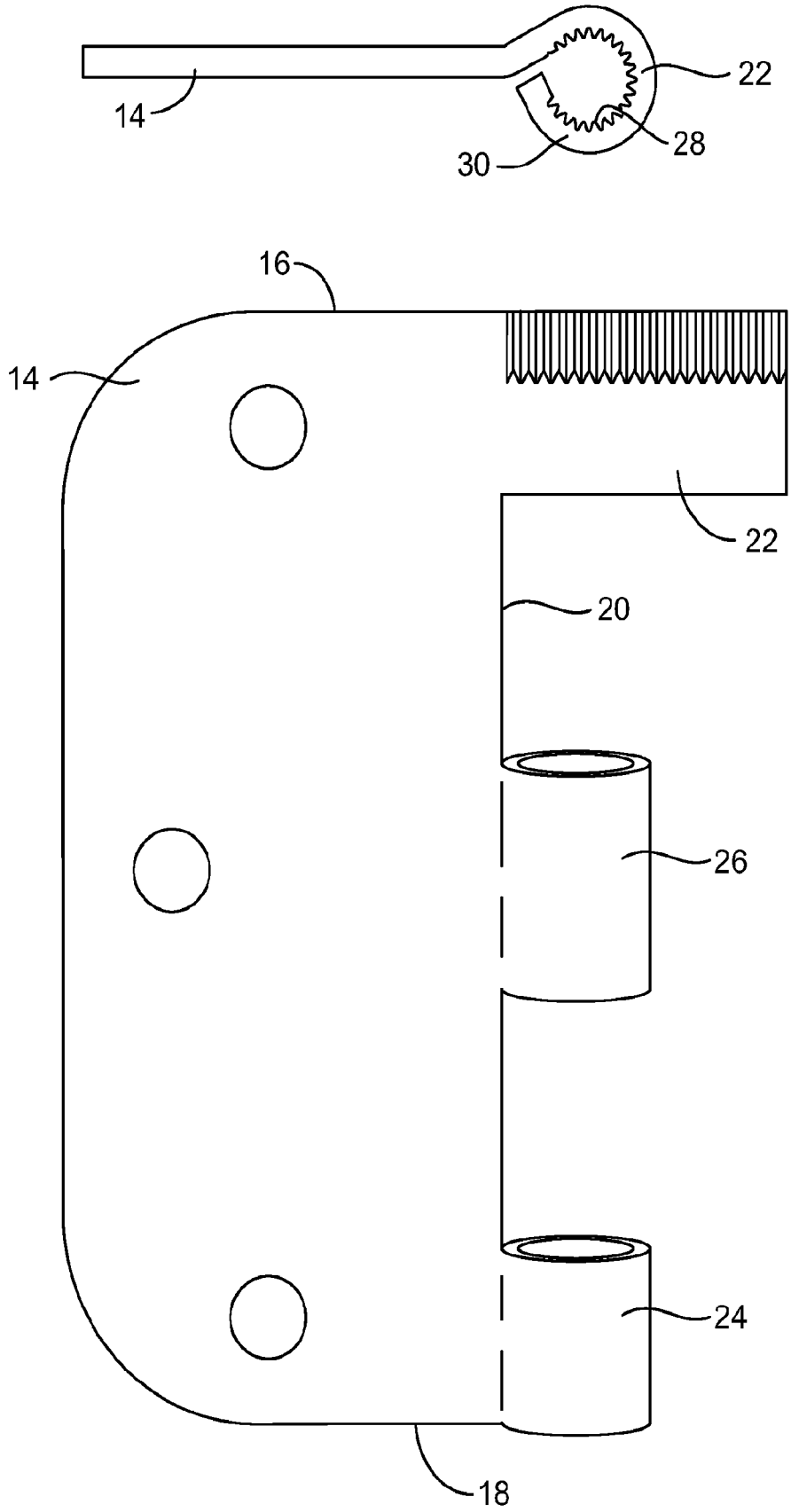
FIG. 2 shows a top and a side view of a first hinge leaf of the embodiment of FIG. 1.

In this embodiment, the first knuckle 22 is formed from an extension of the material (commonly metal) forming the substantially-planar portion 14, where the extension has been bent in a curved way to form a roughly-cylindrical shape. A second knuckle 24 extends from the pivot edge 20 near the bottom edge 18 of the substantially-planar portion 14. The second knuckle 24 is also in a roughly-cylindrical shape. A third knuckle 26 extends from the pivot edge 20 near the center of the pivot edge 20, and is also bent or formed into a roughly-cylindrical shape. FIG. 2 shows more-detailed top and side views of the first hinge leaf 10 of FIG. 1.

As is illustrated in FIG. 2, the first knuckle 22 includes an inner splined surface 28. The inner splined surface 28 is provided on at least an upper portion of the first knuckle 22. The inner splined surface 28 may be formed before the first knuckle 22 is rolled up into its roughly-cylindrical final shape, as shown in the side view of FIG. 2. When the first knuckle 22 is rolled up, the inner splined surface 28 forms a splined opening 30, as shown in the top view of FIG. 3.

The embodiment of the hinge shown in FIG. 1 also includes the second hinge leaf 12. The second hinge leaf 12 includes a substantially-planar portion 32 having a pivot edge 34 which is the edge adjacent to or closest to the axis of rotation of the second hinge leaf 12 with respect to the first hinge leaf 10. A first knuckle 36 and a second knuckle 38 extend from the pivot edge 34 of the substantially-planar portion 32. The first knuckle 36 and the second knuckle 38 each have an inner surface when they are rolled into their roughly-cylindrical forms shown in FIG. 1.

At least one of the first knuckle 36 and the second knuckle 38 includes a knuckle stop element. In the hinge of FIG. 1, the knuckle stop element is a tab 40 extending inward (toward the center of the roughly-cylindrical space defined by the first knuckle 36 and/or the second knuckle 38) from the inner surface of the first knuckle 36 and/or the second knuckle 38. The embodiment of FIG. 1 includes a tab 40 on both the first knuckle 36 and the second knuckle 38, which is shown in outline form in FIG. 1, but is shown in more detail in the side and top views of the second hinge leaf 12 in FIG. 3.

Figure 3:
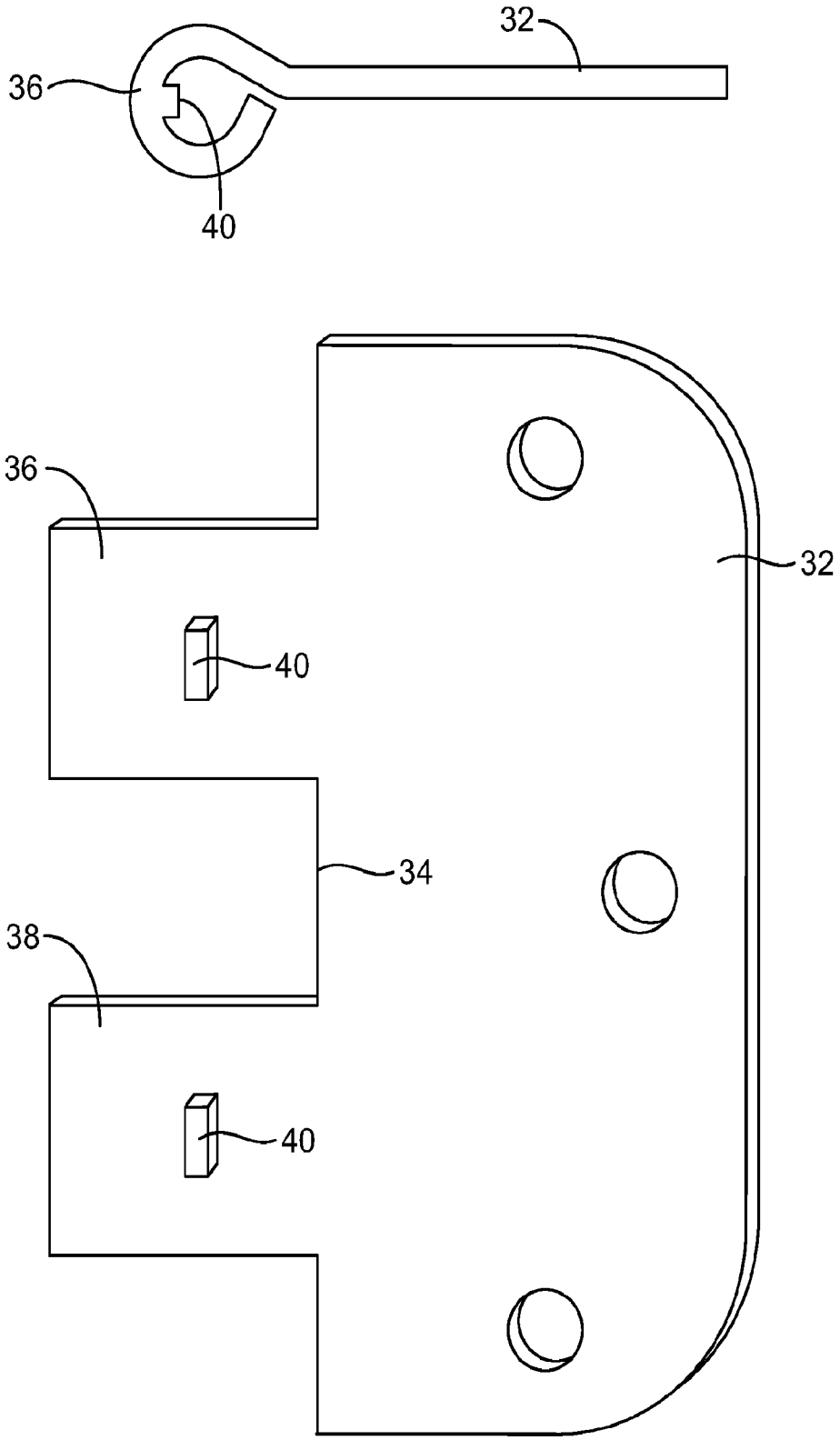
FIG. 3 shows a top and a side view of a second hinge leaf of the embodiment of FIG. 1.

The second hinge leaf 12 is shown with the first knuckle 36 and the second knuckle 38 in rolled form in the top view of FIG. 3, and with the first knuckle 36 and the second knuckle 38 before being rolled in the side view of FIG. 3. Although the views of FIG. 3 show the tabs 40 as being roughly centrally located on the pieces of material that are to be rolled or formed into the first knuckle 36 and the second knuckle 38, it should be understood that the tabs 40 may be located at essentially any vertical or rotational location within the inner surface of the first knuckle 36 and the second knuckle 38 that provides the functionality discussed herein.

Figure 4:
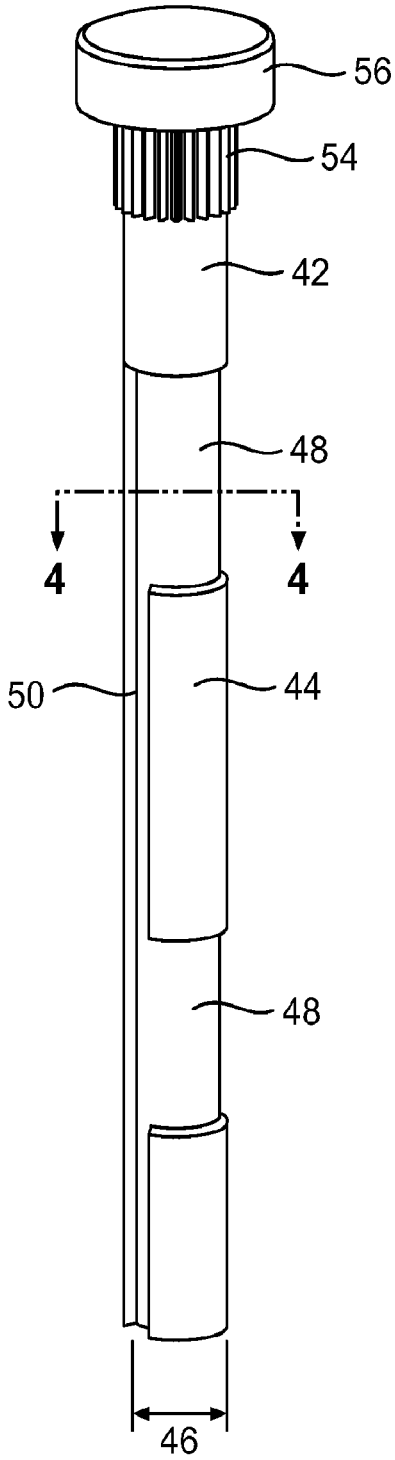
FIG. 4 shows a side view and a cross-sectional view of the hinge pin of the embodiment of FIG. 1.
Figure 4:
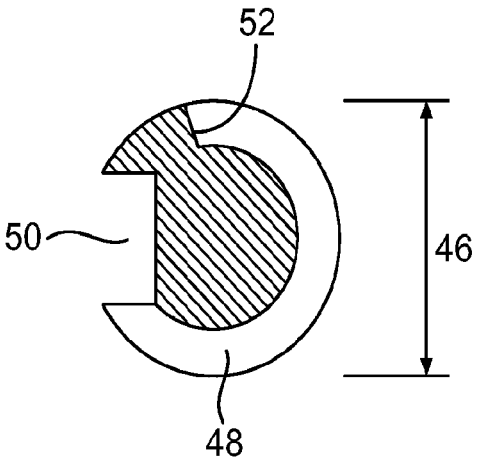

FIG. 1 also shows the third component of the hinge, namely a hinge pin 42. The hinge pin 42 of FIG. 1 is shown in more detail in FIG. 4. FIG. 4 includes a side view of the hinge pin 42, as well as a cross-sectional view of the hinge pin 42 taken along the line 4-4 in the direction shown. The hinge pin 42 includes a shaft 44. The shaft 44 has a shaft diameter 46, which roughly corresponds to the size of the holes passing through the various knuckles, so that when the hinge pin 42 is inserted into the knuckles of the two hinge leaves 10, 12, it forms a snug fit.

In the embodiment of the hinge pin 42 shown in FIG. 4, the shaft 42 is not uniformly cylindrical. Instead, the shaft includes a circumferential channel 48 at a longitudinal location corresponding to the first knuckle 36 of the second hinge leaf 12 and another circumferential channel 48 at a longitudinal location corresponding to the second knuckle 38 of the second hinge leaf 12. As may best be seen in the cross-sectional view of FIG. 4, the circumferential channels 48 extend circumferentially around the shaft 42 from a longitudinal channel 50 to a longitudinal edge 52. The longitudinal edge 52 of each circumferential channel forms a hinge pin stop element that is configured to engage the first knuckle stop element (e.g. tab 40) and the second knuckle stop element (e.g. tab 40) at a certain rotational position of the hinge pin 42 with respect to the second hinge leaf 12.

The hinge pin 42 also includes an upper splined portion 54. The upper splined portion 54 has a plurality of fingers that extend beyond the shaft diameter 46 so that the effective diameter of the upper splined portion 54 is slightly larger than the shaft diameter 46 of the remainder of the shaft 44. Therefore, although the hinge pin 42 may also have a head 56 similar to the heads of standard hinge pins, some embodiments of the hinge pin 42 need not have a conventional head such as head 56, as the slightly-larger diameter of the upper splined portion 54 serves to prevent the hinge pin 42 from moving too far down or falling out of the hinge.

The longitudinal channel 50 serves to permit the hinge pin 42 to enter into the knuckles of the hinge leaves 10, 12 as the hinge is assembled, including entering into the first knuckle 36 and the second knuckle 38 of the second hinge leaf 12, even with the presence of the tabs 40. Thus, the hinge is assembled such as described in the following manner for use with a door. The first hinge leaf 10 is attached to one of a door and a door frame. The second hinge leaf 12 is attached to the other of the door and the door frame at a position corresponding to the location of the first hinge leaf 10, as with other hinges known in the art. This process may be repeated for any other hinges being used for the door. All of the hinges may have hinge-integrated door stops of the type discussed herein, or only a subset of the hinges (e.g. one hinge or two hinges of a three-hinge door) may have hinge-integrated door stops. Once all hinge leaves for all hinges are attached to the door and frame, the door is positioned proximate the door frame such that the openings of the knuckles of the various hinge leaves of the various hinges are substantially aligned.

The hinge pin 42 of one hinge is then inserted into the first knuckle 22 of the first hinge leaf 10 and partially into the first knuckle 36 of the second hinge leaf 12 until the hinge pin 42 reaches the tab 40 of the first knuckle 36. If the hinge pin 42 is not rotated so that the longitudinal channel 50 aligns with the tab 40, the hinge pin 42 strikes the tab 40 and further insertion is impeded. Therefore, the hinge pin 42 is rotated with respect to the second hinge leaf 12 until the longitudinal channel 50 aligns with the tab 40, and the hinge pin 42 can then be further inserted through the first knuckle 36, through the third knuckle 26 of the first hinge leaf 10, and into the second knuckle 38 of the second hinge leaf 12.

The tab 40 of the second knuckle 38 may also impact the hinge pin 42 if slight rotation of the hinge pin 42 occurs while the tab 40 of the first knuckle 36 is aligned with one of the circumferential channels 48. Alternatively, depending on the spacing of the various knuckles, the tab 40 of the first knuckle 36 may impact on an upper surface of the circumferential channel 48. Regardless, this additional impediment may be cleared by slight rotation of the hinge pin 42 with respect to the second hinge leaf 12 until the hinge pin 42 can be almost fully inserted into the hinge.

In most circumstances, insertion of the hinge pin 42 stops just before the upper splined portion 54 enters into and engages with the inner splined surface 28 of the first knuckle 22 of the first hinge leaf 10. Insertion of the hinge pins 42 of the other hinges occurs similarly until all hinge pins 42 of hinges of the type including hinge-integrated door stops are inserted with the upper splined portions 42 located just above the inner splined surface 28. When the hinge pins 42 are inserted in this way, but not fully inserted, the tabs 40 (or other hinge leaf stop elements) are located within the circumferential channels 50, near the bottom of each circumferential channel 50. This allows the hinge pins 42 to be rotated with respect to both of the first hinge leaf 10 and the second hinge leaf. The hinge pins 42 are therefore rotated to a position defining a stop position for the door (a position where, when the door is opened or otherwise moved to that position, the hinge pin stop element (e.g. the longitudinal edge 52) engages the knuckle stop element (e.g. the tab 40) to stop further rotational motion of the door). Thereafter, the hinge pin 42 is fully inserted into the hinge, whereby the upper splined portion 54 engages the inner splined surface 28, preventing further rotation of the hinge pin 42 with respect to the first hinge leaf 10.

When the hinge pin 42 is fully inserted into the hinge, the circumferential channels 48 are each wholly or largely contained within one of the first knuckle 36 and the second knuckle 38 of the second leaf 12. Therefore, when the hinge pin 42 is fully inserted, at least a portion of each of the first knuckle 36 and the second knuckle 38 surround a portion of the hinge pin 42 that has the shaft diameter 46 with the exception of at most the longitudinal channel 50. This maintains or improves the stability of the hinge such that the stability of the hinge is not significantly less than that of a standard hinge.

Because of the engagement of the upper splined portion 54 with the inner splined surface 28, the stop position of the hinge is adjustable to a wide variety of positions, as defined by the fingers of the splined portion 54 and the inner splined surface 28. The adjustability is provided during initial installation, and is always available for later adjustment as needed. For later adjustment, the hinge pin 42 is simply tapped upward slightly so that the upper splined portion 54 no longer engages the inner splined surface 28, and then the hinge pin 42 is turned to a new position with respect to the first hinge leaf 10 and tapped back down.

To ensure a desired positioning of the hinge pin 42 with respect to the first hinge leaf 10, a variety of methods may be used. As one example, the head 56 or one of the fingers of the upper splined portion 54 may be marked to show where the second leaf will stop with respect to the hinge pin 42. Therefore, the hinge pin 42 may be rotated until the mark is pointing in the desired direction, and the hinge pin 42 is then fully inserted. Alternatively, while the door is at a position less open than the desired stop position, the hinge pin 42 may be rotated until the hinge pin stop element (e.g. the longitudinal edge 52) engages the knuckle stop element (e.g. the tab 40). Then, the door is opened to the desired stop location. The opening of the door causes the knuckle stop element to push on the pin stop element, thereby rotating the hinge pin 42 with respect to the first hinge leaf 10. While the door is in the desired stop position, the hinge pin 42 is fully inserted into the hinge, locking the stop position.

In still another alternative, the door is opened to the desired stop position, and the hinge pin 42 is rotated until the hinge pin stop element engages the knuckle stop element. Once engagement is reached, the hinge pin 42 is fully inserted into the hinge, the upper splined portion 54 engages the inner splined surface 28, and the stop position is locked. It should be apparent that where multiple hinges with hinge-integrated stops are used, combinations of these procedures could be used with the various hinges. Once all hinge pins 42 of the various hinges are in place and fully inserted, the hinge pin stop element or elements of each hinge pin 42 are substantially aligned with the hinge pin stop elements of the other hinge pin 42 or hinge pins 42.

Figure 5:
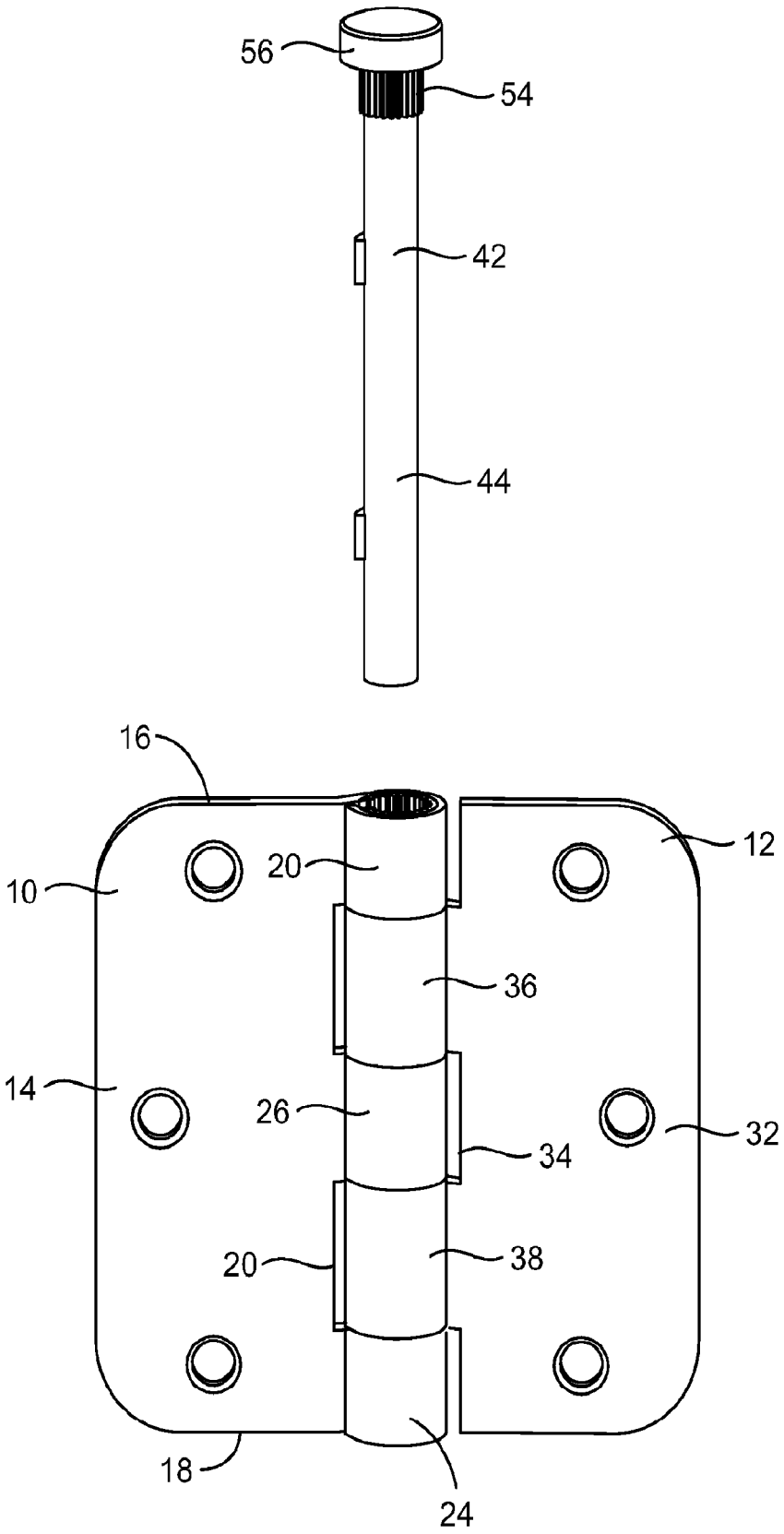
FIG. 5 shows a view of an alternate embodiment of a hinge with a hinge pin removed for illustration purposes.
Figure 6:
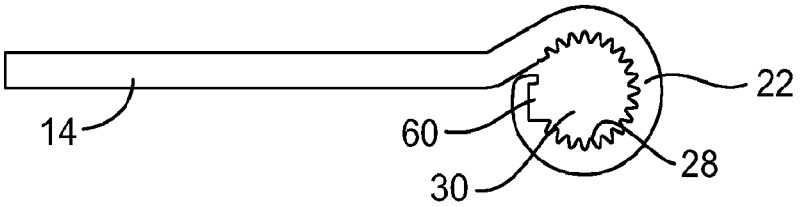
FIG. 6 shows a top view and a partial side view of a first hinge leaf of the embodiment of FIG. 5.
Figure 6:
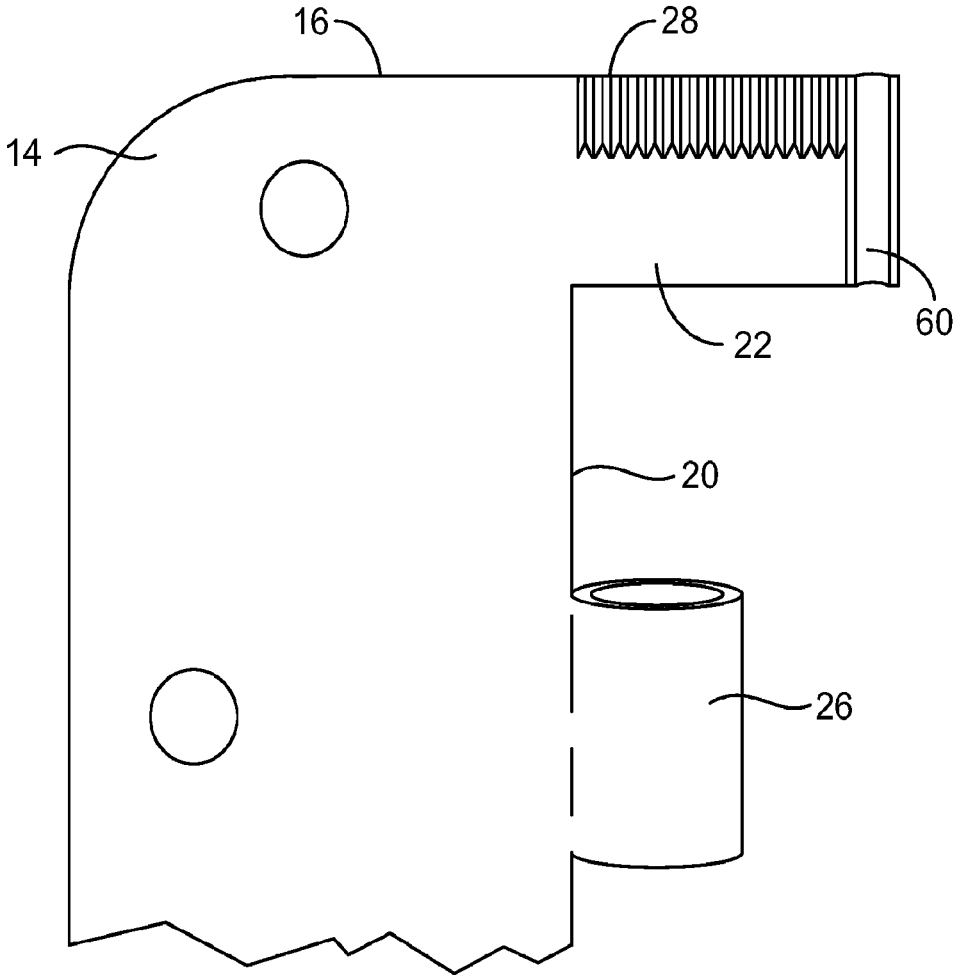
Figure 7:
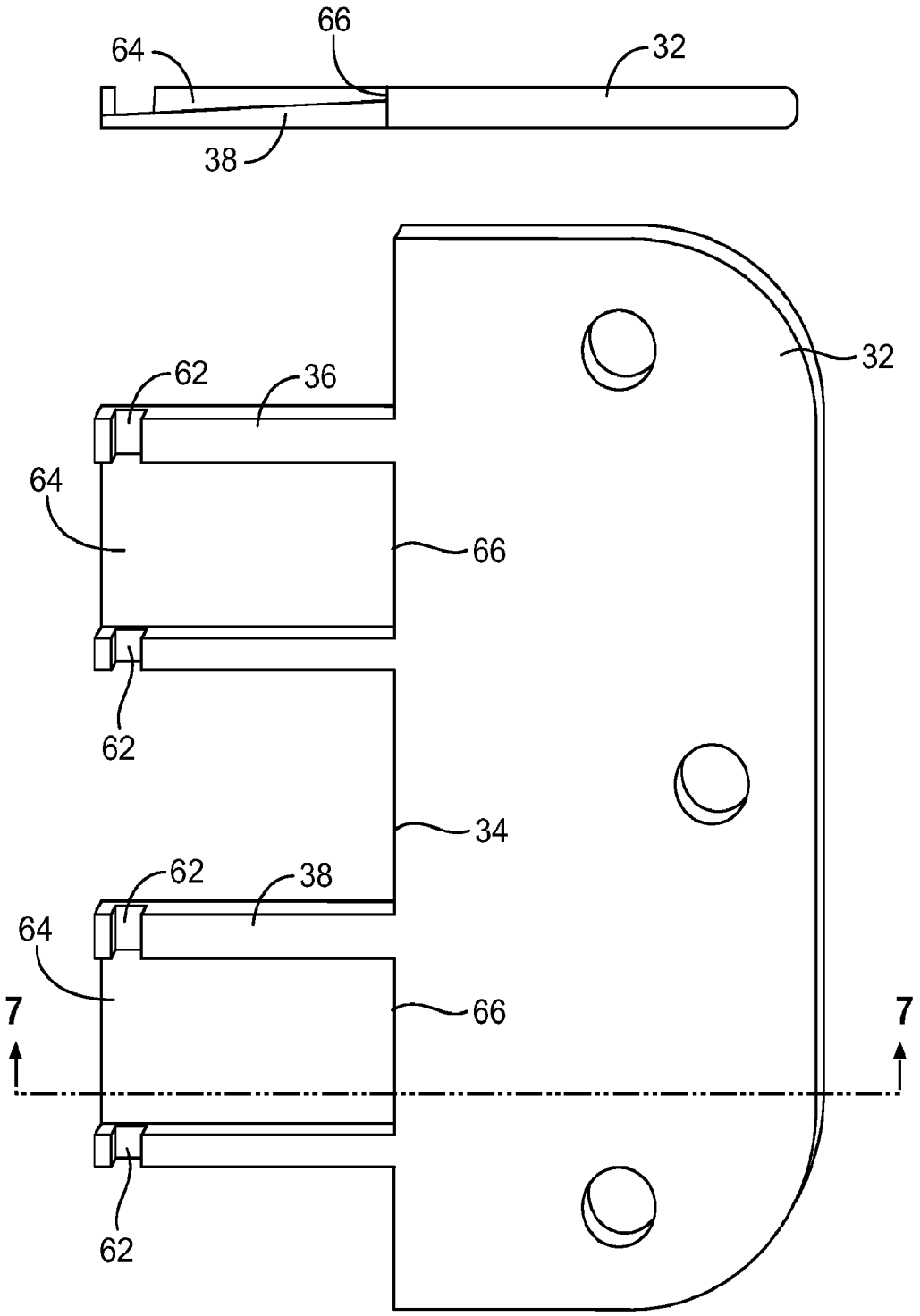
FIG. 7 shows a cross-sectional view and a side view of a second hinge leaf of the embodiment of FIG. 6.
Figure 8:
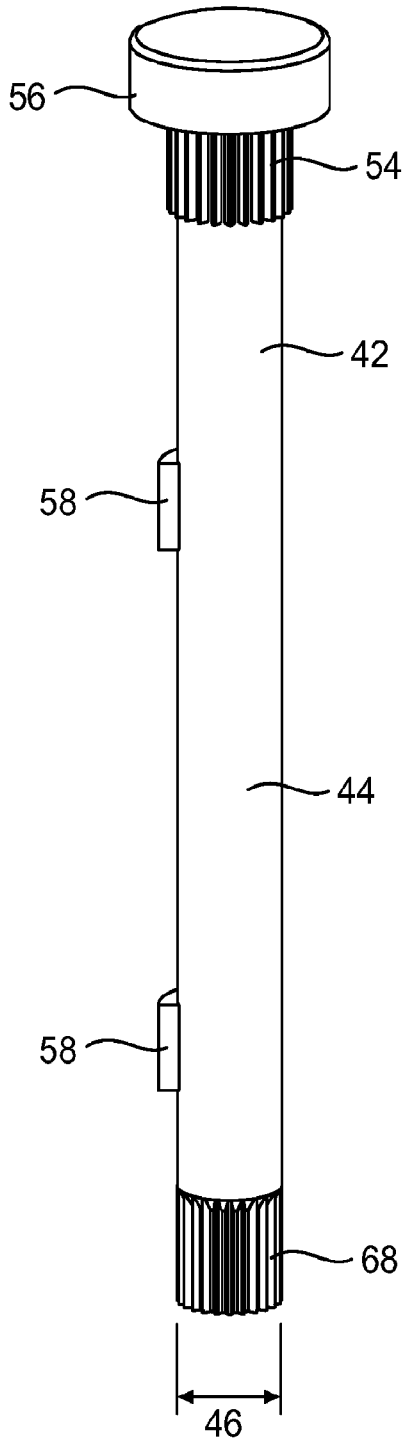
FIG. 8 shows a side view of a hinge pin similar to the hinge pin of the embodiment of FIG. 5.

FIGS. 5-8 show an embodiment of an alternate hinge, where the hinge pin stop element and the knuckle stop element are a different type of element. FIG. 5 shows a complete hinge, FIG. 6 shows top and partial side views of the first hinge leaf 10, FIG. 7 shows a side view of the second hinge leaf 10 and a cross-sectional view of the second hinge leaf 10 taken along the line and in the direction 7-7 shown, and FIG. 8 shows an alternative hinge pin 42. Features of this type of embodiment are similar in many ways to the embodiments discussed with respect to FIGS. 1-4.

Therefore, the first hinge leaf 10 includes the substantially-planar portion 14 having the top edge 16, the bottom edge 18, and the pivot edge 20. In the first hinge leaf 10, the first knuckle 22 extends from the pivot edge 20 near the top edge 16, the second knuckle 24 extends from the pivot edge 20 near the bottom edge 18, and the third knuckle 26 extends from the pivot edge 20 near the center of the pivot edge 20. The second hinge leaf 12 also includes the substantially-planar portion 32 having the pivot edge 34. In the second hinge leaf 12, the first knuckle 36 and the second knuckle 38 extend from the pivot edge 34. The various knuckles form roughly-cylindrical openings sized to snugly receive the hinge pin 42. However, as may be seen in FIGS. 5 and 8, the hinge pin 42 of this embodiment is configured differently.

The hinge pin 42 includes the shaft 44, upper splined portion 54 and, optionally, the head 56. Additionally, the shaft 44 has the shaft diameter 46 and the upper splined portion 54 includes fingers extending beyond the shaft diameter 46. The hinge pin 42 of this embodiment lacks the circumferential channel 48 and the longitudinal channel. Instead, the hinge pin 42 is provided with a pair of tabs 58 placed to correspond to the first knuckle 36 and the second knuckle 38 of the second hinge leaf 12. In some embodiments, only a single tab 58 is used. In the illustrated embodiment and in other similar embodiments, the tab 58 serves as the hinge pin stop element.

To accommodate the modified hinge pin 42 and to provide the door stopping function, the various knuckles of the first hinge leaf 10 and the second hinge leaf 12 are formed differently from the previously-discussed embodiments. Specifically, with respect to the first hinge leaf, at least the first knuckle 22 is modified as shown in FIG. 6. The inner surface of the first knuckle 22 is modified to include a vertical channel 60. The vertical channel 60 allows the hinge pin 42 to pass through the first knuckle 22 with the tab 58 passing through the vertical channel 60. In embodiments where the hinge pin 42 includes two tabs 58, the third knuckle 26 also includes a similarly-placed vertical channel 60.

Similarly, the first knuckle 36 and the second knuckle 38 of the second hinge leaf 12 are provided with corresponding vertical channels 62. The vertical channels allow the hinge pin 42 to pass into the first knuckle 36 and the second knuckle 38 with the tab 58 passing through the vertical channels 62. In this embodiment, for insertion of the hinge pin 52 to occur, the vertical channel 62 or vertical channels 62 of the second hinge leaf 12 must be substantially aligned with the vertical channel 60 or vertical channels 60 of the first hinge leaf 12. When the hinge pin 42 is inserted into the hinge until the upper splined portion is slightly above and not engaging with the inner splined surface 28, the tabs 58 are wholly located within a circumferential channel 64 on an inner surface of the first knuckle 36 and/or the second knuckle 38 of the second hinge leaf 12. Thereafter, the first hinge leaf 10 and second hinge leaf 12 may be rotated with respect to one another, and the location of the stop position of the door set as previously described. In this embodiment, a substantially-vertical edge 66 of the circumferential channel 64 serves as the knuckle stop element that engages the hinge pin stop element (e.g. tab 58) to stop relative movement between the first hinge leaf 10 and the second hinge leaf 12.

Although not present in all embodiments, the cross-sectional view of the second hinge leaf 12 shown in FIG. 7 illustrates one feature that may be incorporated into some embodiments of the invention, including types similar to the embodiment of FIG. 1 and types similar to the embodiment of FIG. 5. This feature is that at least one of the circumferential channels 64 has a varying depth that is shallower proximate the substantially-vertical edge 66. The shallower depth of the circumferential channel 64 may cause frictional engagement with the tab 58, causing the door to be more likely to slow at least slightly or even stop before the hinge pin stop element and the knuckle stop element fully engage to stop the door. This may serve to reduce or prevent sudden stops of the door and may also serve to lessen rebound of the door after hitting the stop. A similar feature incorporated in the embodiment of FIG. 1 utilizes a circumferential channel 48 having a similarly-varying depth.

Figure 9:
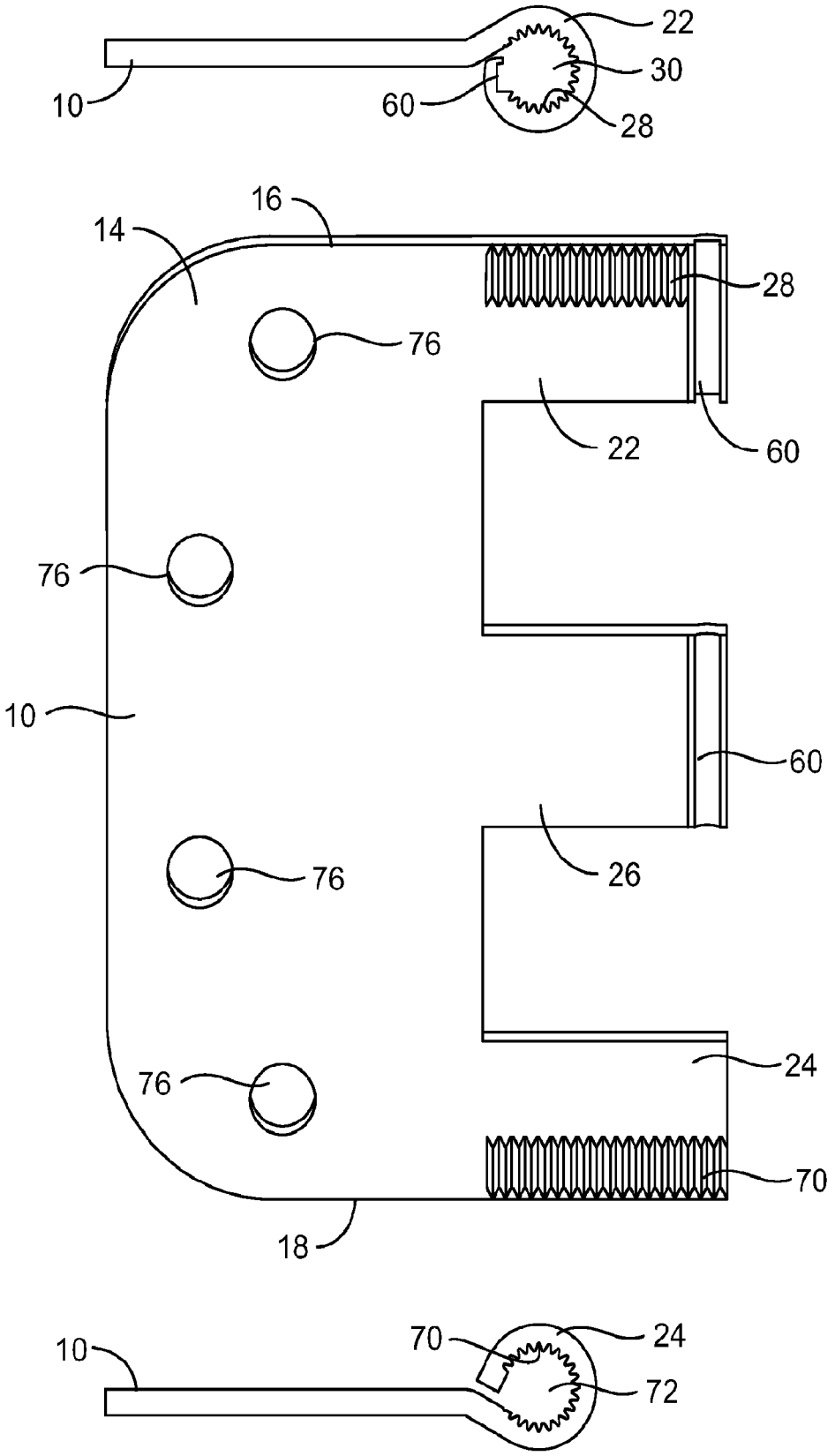
FIG. 9 shows top, side, and bottom views of a first hinge leaf having inner splined surfaces on multiple knuckles.

The hinge pin 42 illustrated in FIG. 8 illustrates an additional feature that may be provided for some embodiments. To increase the strength and the security of the positioning of the hinge pin 42 with respect to the first hinge leaf 10, a lower end of the shaft 44 may be provided with a lower splined portion 68. The lower splined portion 68 has fingers that extend no farther than the shaft diameter 46, so that the lower splined portion 68 is able to pass thorugh the various knuckles. The lower splined portion is configured to engage with an inner splined surface 70 of the second knuckle 24 of the first hinge leaf 10 (this inner splined surface is not shown, but may be similar to the inner splined surface 28), as illustrated in the embodiment of the first hinge leaf 10 shown in FIG. 9. The inner splined surface 70 of the second knuckle 24 in such embodiments defines a splined opening 72 (when the second knuckle is in a rolled configuration) that is narrower than the splined opening 30 defined by the inner splined surface 28 of the first knuckle 22. FIG. 9 shows an embodiment of the first hinge leaf 10 in accordance with such embodiments.

Figure 10:
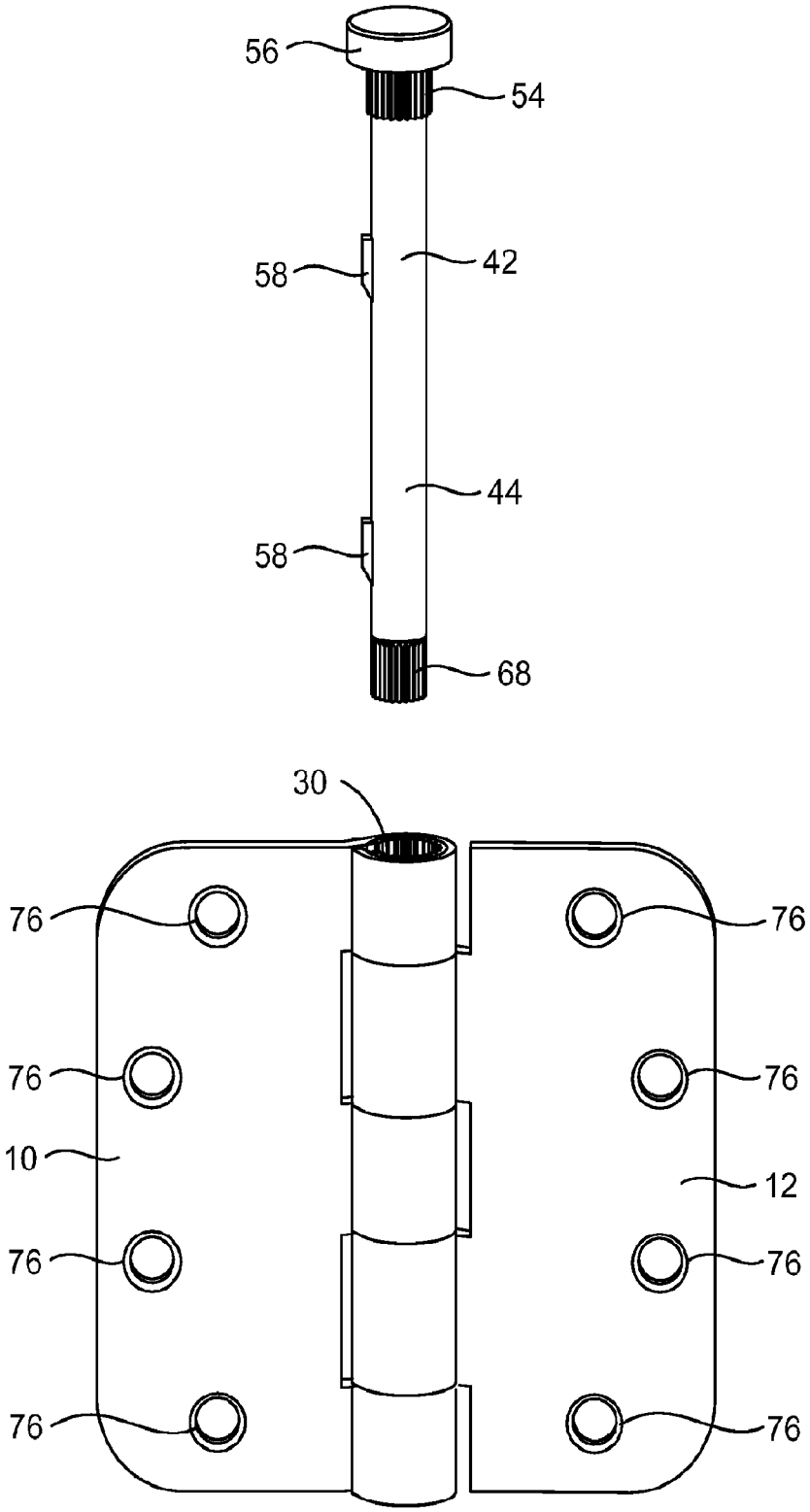
FIG. 10 shows an embodiment of a hinge with a hinge pin removed for illustration purposes.
Figure 11:
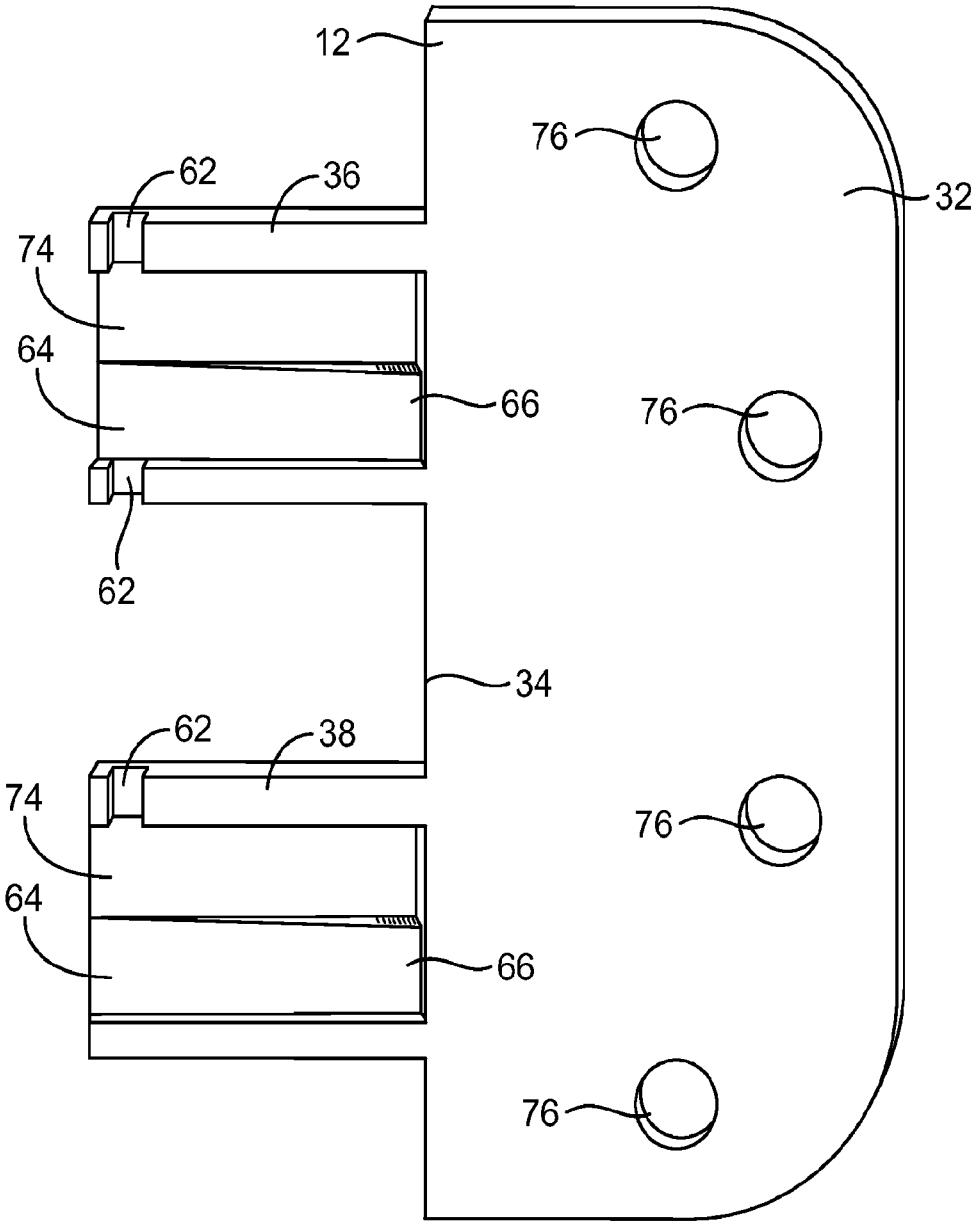
FIG. 11 shows an alternate embodiment of a second hinge leaf.

FIG. 10 shows another embodiment of a hinge, with the hinge pin 42 removed from the hinge for illustration purposes. The tabs 58 of the hinge pin 42 of this embodiment include a sloped lower edge, the purpose of which will be discussed with respect to the accompanying embodiment of the second hinge leaf 12 shown in FIG. 11. This embodiment includes the circumferential channel 64, in which a lower portion includes the varying depth as discussed above, and an upper un-sloped portion 74 is also provided. This un-sloped portion 74 may make it easier to set the hinge pin stop location during use of the hinge, as the tabs 58 on the hinge pin 42 do not encounter resistance when they are located in the un-sloped portion 74 and the hinge pin 42 is rotated with respect to the second hinge leaf 12. Then, when the desired set location is reached, the hinge pin 42 is to be pushed downward. The sloped lower edge of the tabs 58 assists the user in overcoming any resistance encountered as the lower edge of the tabs 58 engages the varying-depth portion of the circumferential channel 64, making final insertion of the hinge pin 42 easier.

Figure 12:
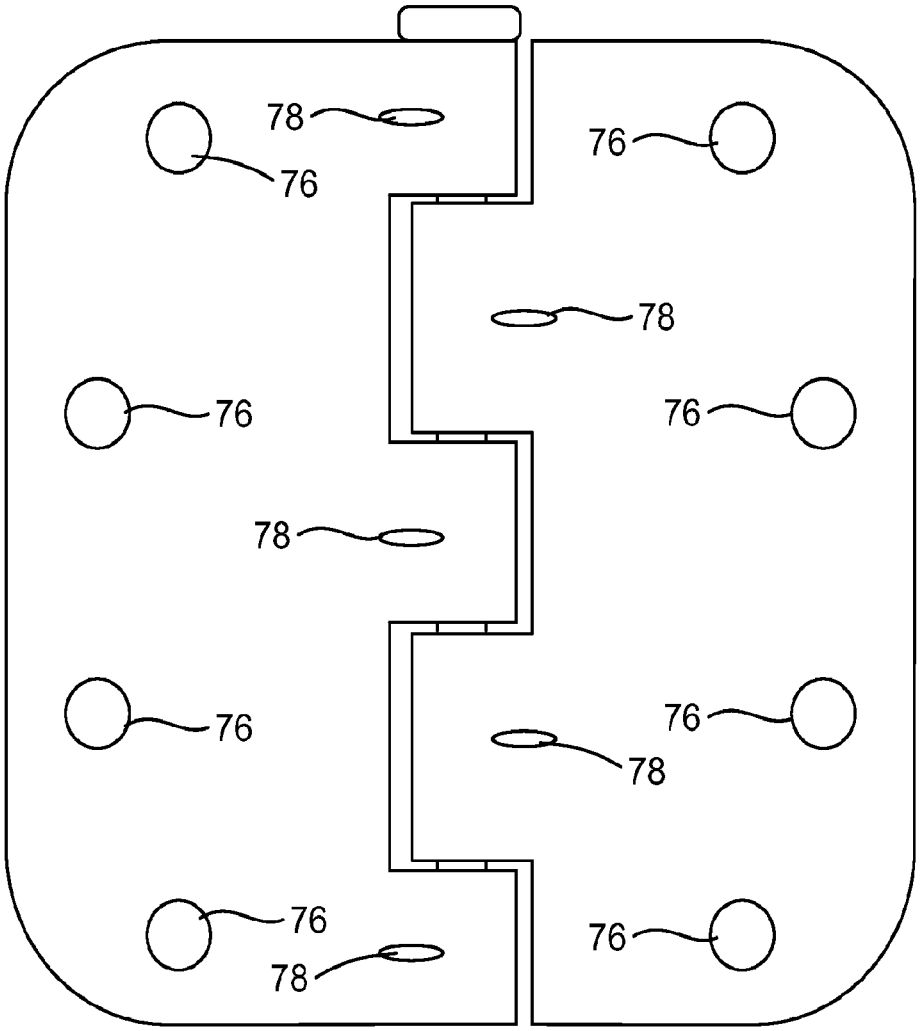
FIG. 12 shows an alternate embodiment of a hinge.

FIG. 12 shows an embodiment of a hinge and illustrates features that may be incorporated into the hinge to improve strength of the hinge. Improving strength of the hinge may be desirable in some embodiments as greater forces may be encountered at the hinge than are encountered at the hinge with other types of door stops, due to the greater leverage at the hinge. The embodiment of FIG. 12 shows four mounting holes 76 on each of the first hinge leaf 10 and the second hinge leaf 12 (rather than the three mounting holes shows in some other illustrated embodiments). The additional mounting hole 76 may ensure more secure connection to a door and door frame, preventing or reducing the likelihood of stripping out screws from the door and/or frame. Additionally, a crease 78 has been added to each of the various knuckles proximate the joint of the knuckles to the respective substantially-planar portions. The crease 78 increases the resistance of that portion of the knuckle to unwanted bending from the original location. Although not shown in FIG. 12, similar (or further) strengthening of the various knuckles may be achieved by spot welding each knuckle once it is rolled into its final configuration.

Even with strengthening features such as those illustrated in FIG. 12, it is envisioned that forces larger than desired may occasionally be applied to a hinge. While FIG. 12 illustrates features that improve strength of the hinge, other features may be provided to deal with exceptional large forces. For example, with respect to embodiments incorporating tabs 58 on the hinge pin 42, the tabs 58 may be designed to break from the shaft 44 at a desired force level. Additionally, even if the tabs 58 are not so designed, the design of such embodiments of the hinge is such that it is anticipated that the most common mode of failure of the hinge-integrated stop will be breakage of the tabs 58. When the tabs 58 are broken, they remain contained within the first knuckle 36 and the second knuckle 38, and the hinge then functions as a normal hinge. Thus, even when failure (designed or otherwise) occurs, the hinge continues to function as a normal hinge. Repair of the hinge to full door-stop functionality is easily achieved by simply purchasing a new matching hinge pin 42. The old, broken, hinge pin 42 is removed, whereupon the broken tabs 58 simply fall out the bottom of the hinge. The new hinge pin 42 is inserted and set as discussed above, and full functionality of the hinge-integrated stop is restored. Hinges and hinge pins 42 in accordance with embodiments of the invention can therefore be made and/or sold that incorporate specific known breaking points of the tabs 58 so as to prevent unwanted damage to a door or frame attached to the hinge.

Figure 13:
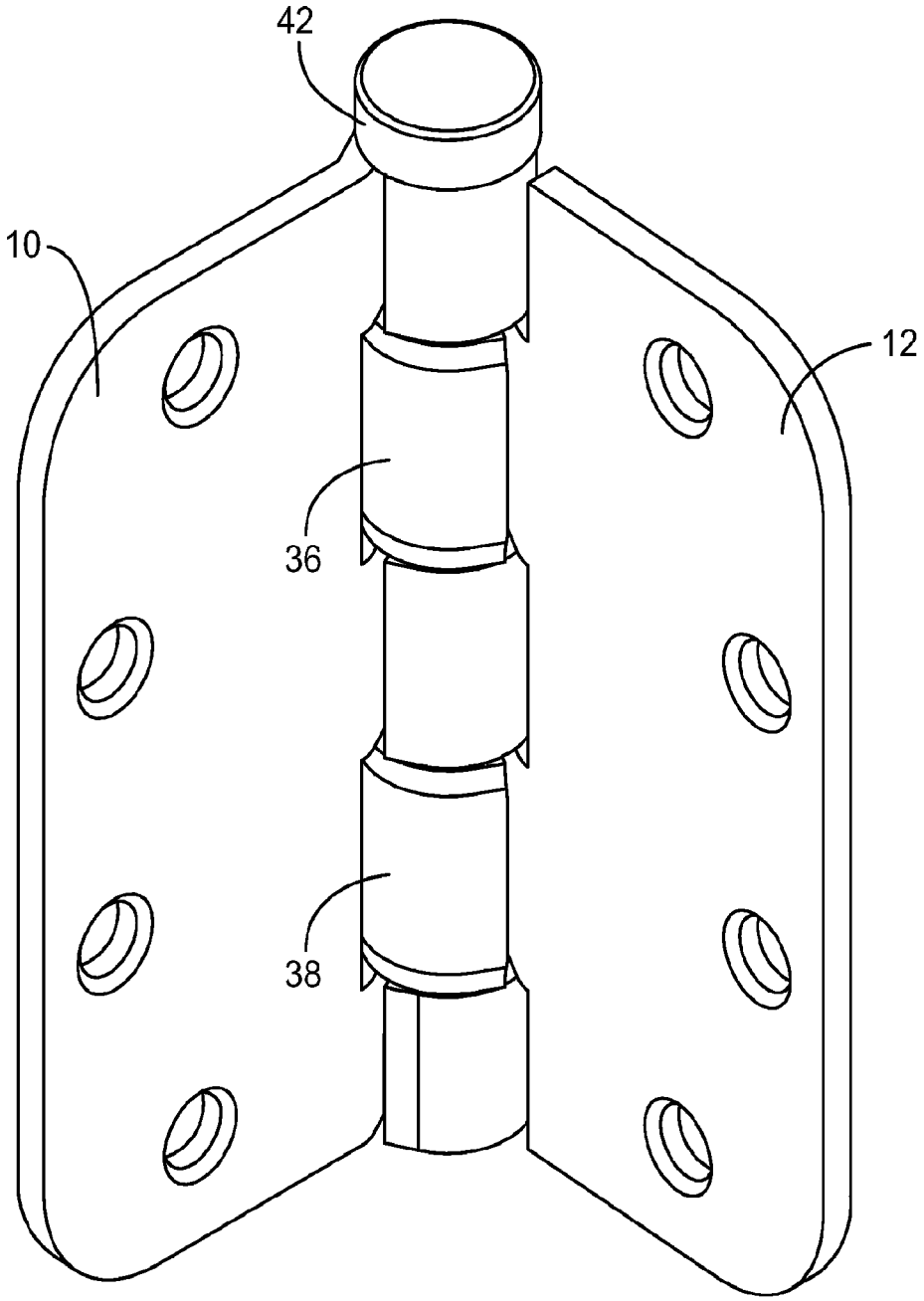
FIGS. 13-23 show various perspective views of another embodiment of a hinge.
Figure 14:
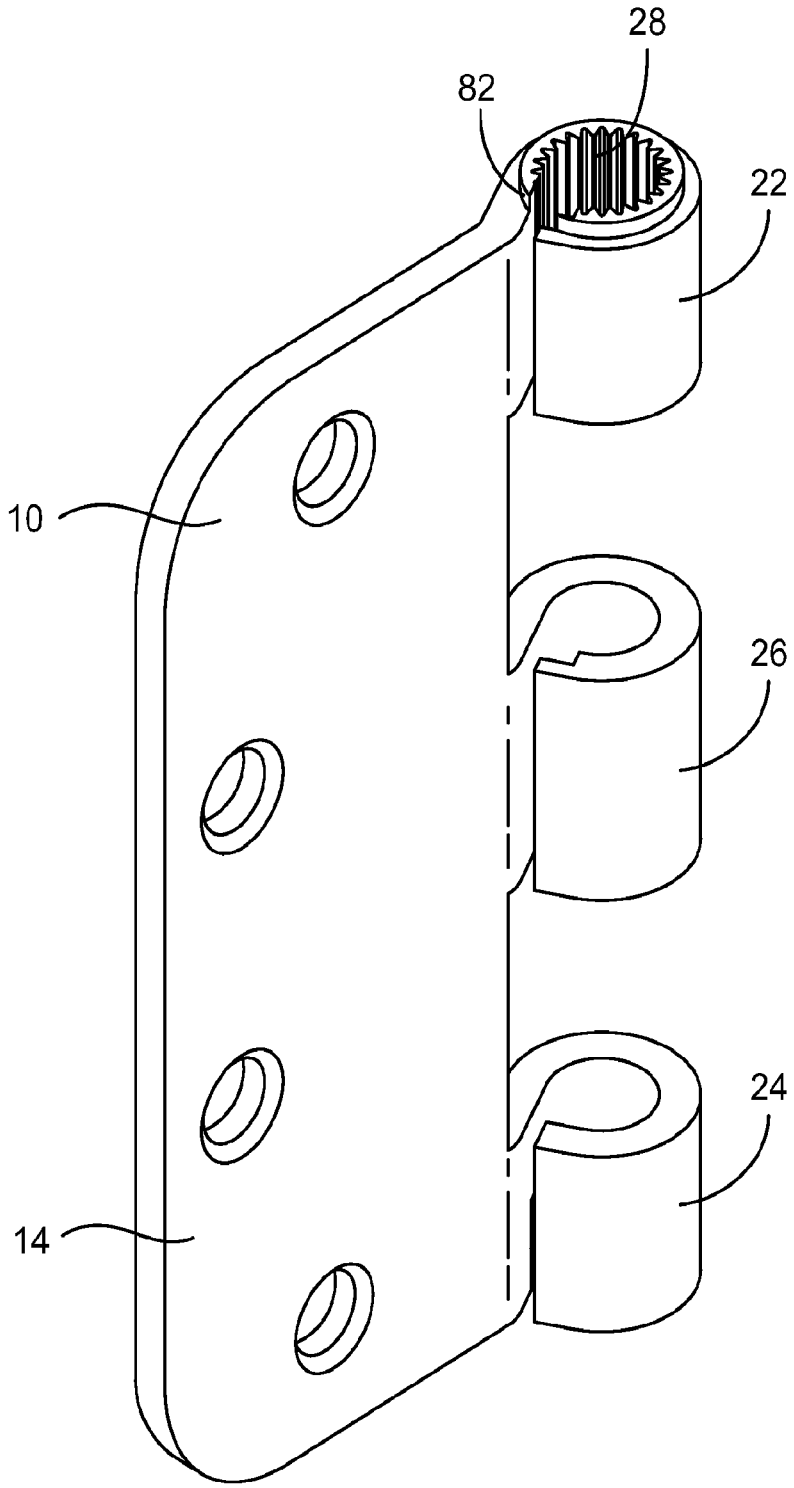
Figure 16:
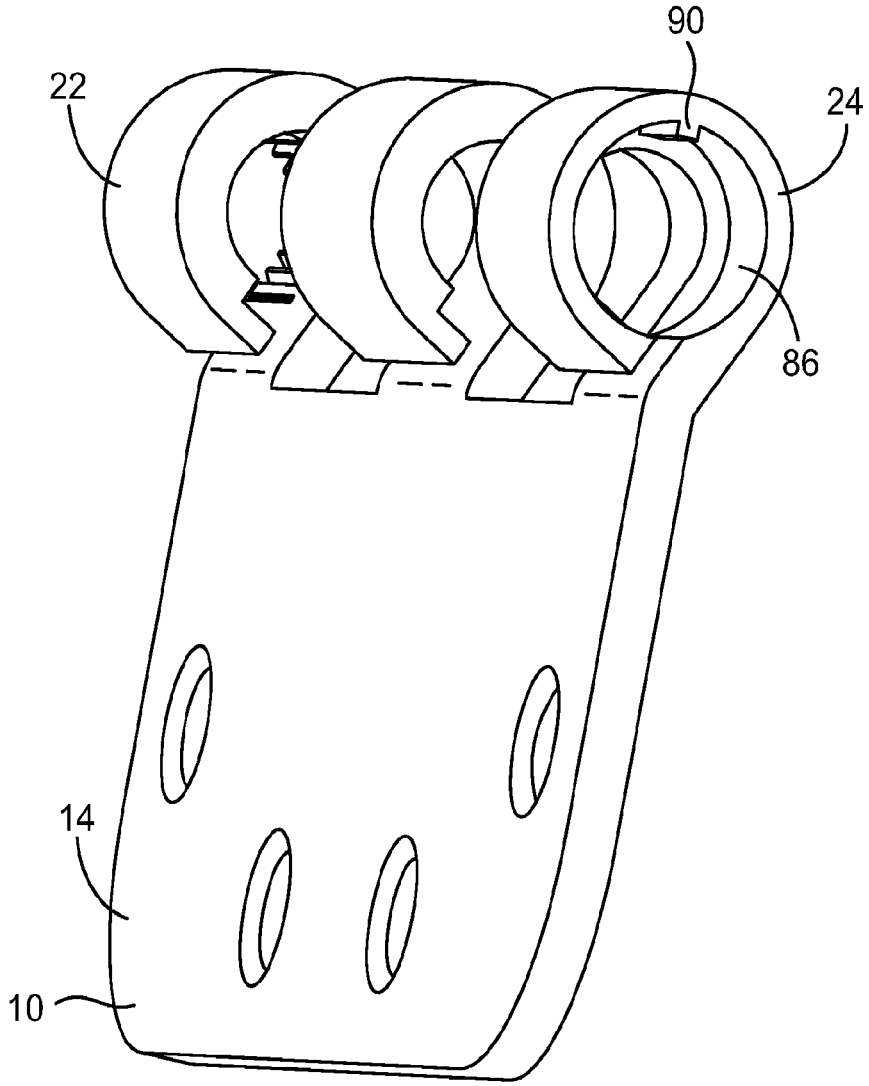
Figure 17:
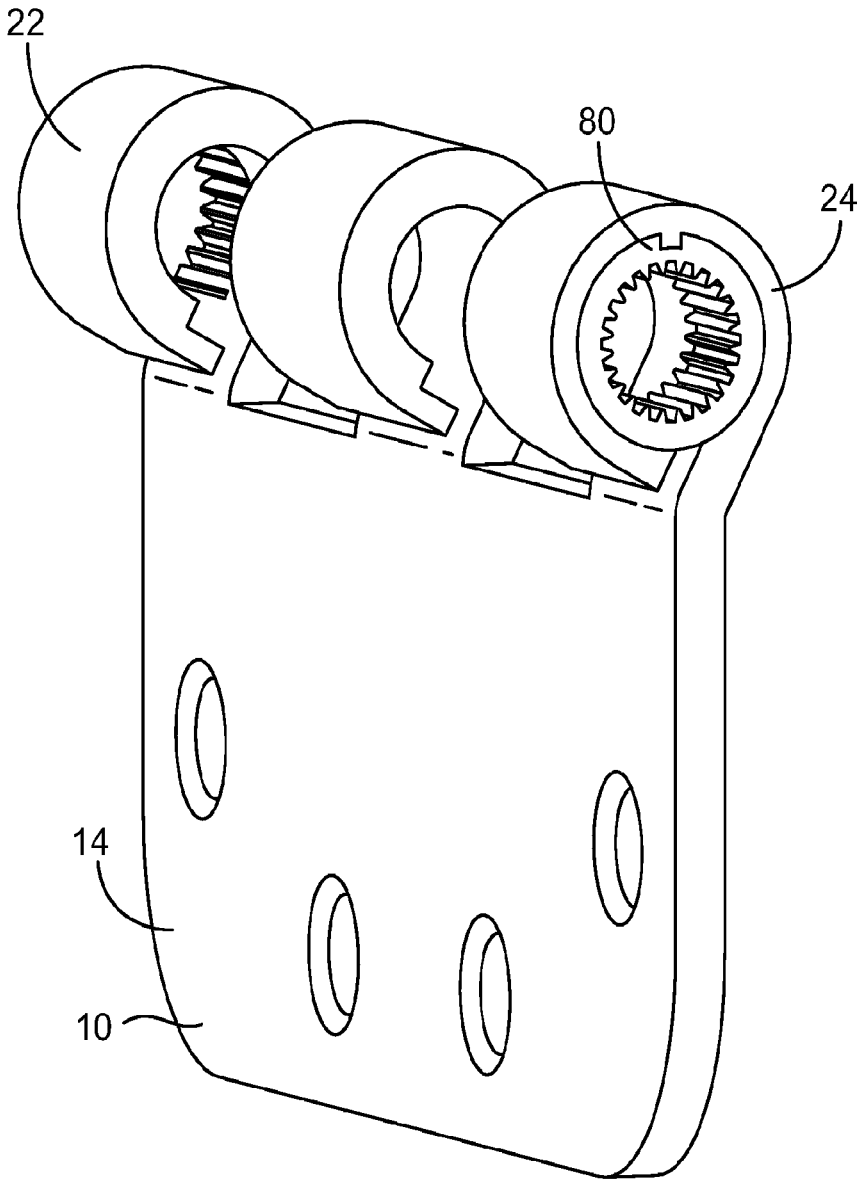
Figure 18:
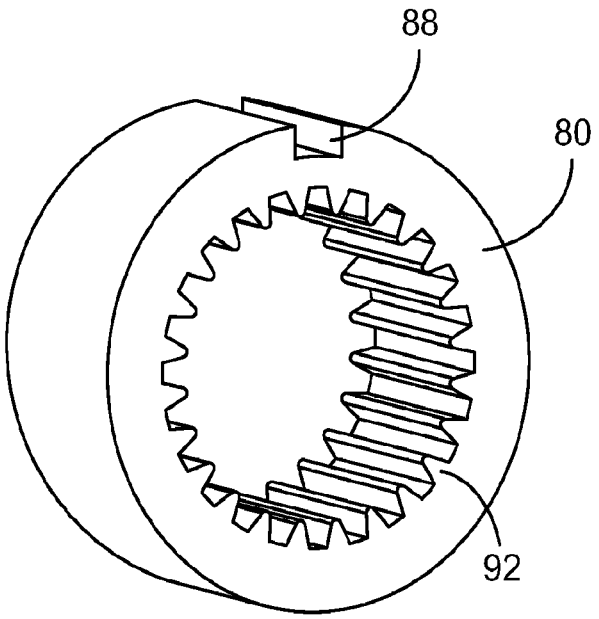
Figure 19:
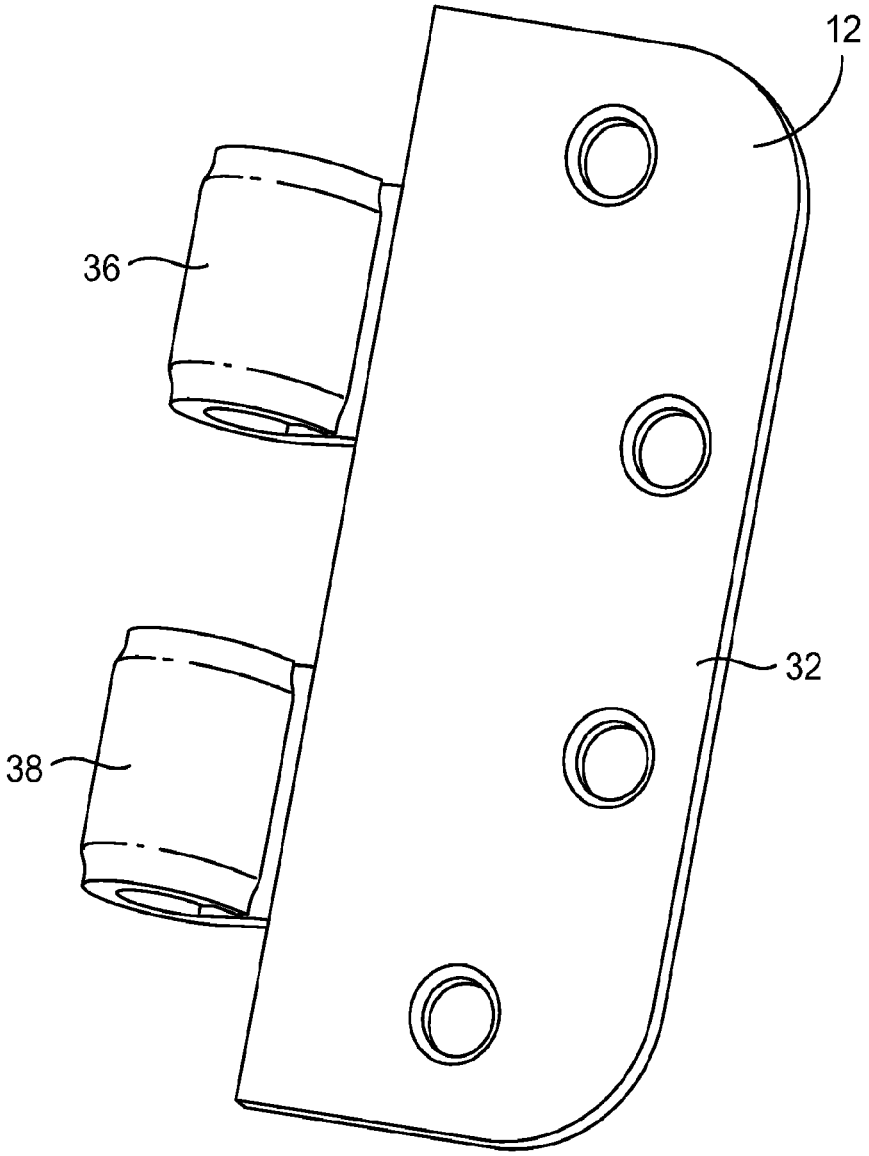
Figure 20:
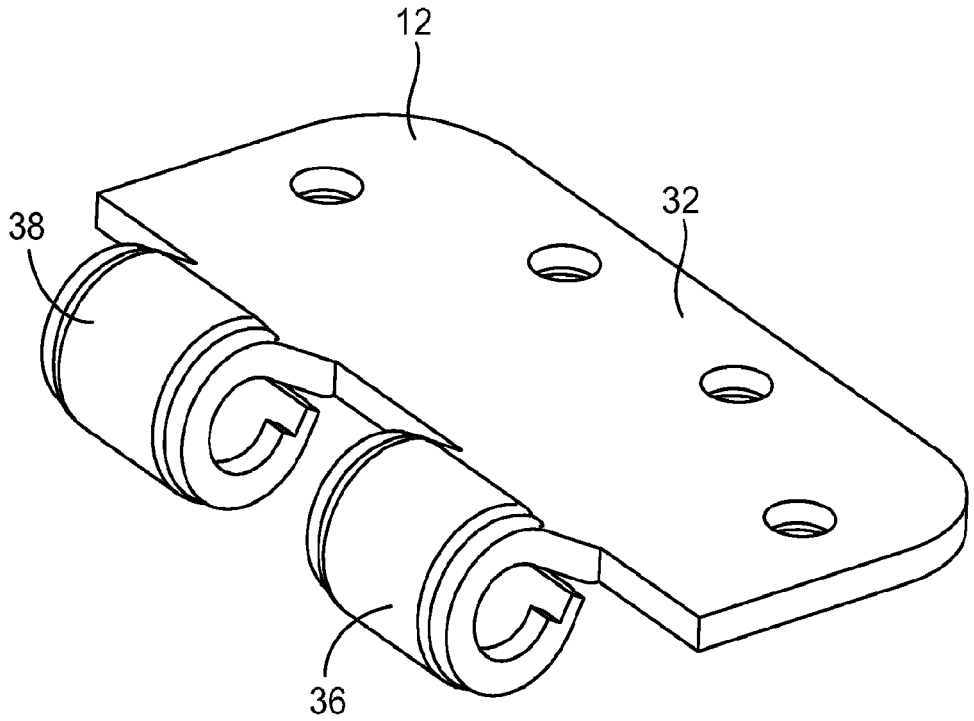
Figure 23:
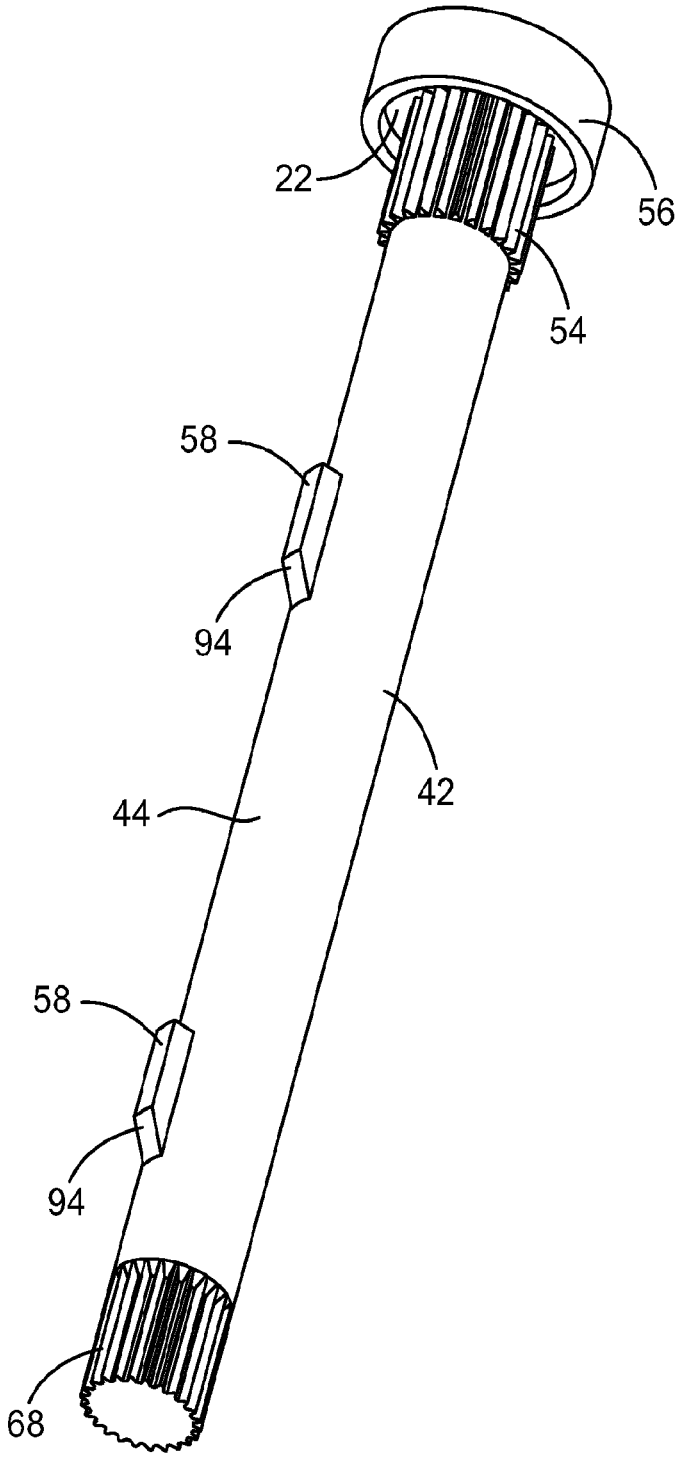

FIGS. 13-23 illustrate various views of another embodiment of the invention. FIG. 13 shows a perspective view of the assembled hinge. FIGS. 14-17 show various perspective views of the first hinge leaf 10 of this embodiment. FIG. 18 shows a perspective view of a splined insert 80 for insertion into the second knuckle 24 of the first hinge leaf, as is shown inserted in FIG. 17. FIGS. 19-22 show various perspective views of the second hinge leaf 12 of this embodiment. FIG. 23 shows a perspective view of the hinge pin 42 of this embodiment.

As is illustrated in FIG. 13, when the hinge of this embodiment is assembled, it substantially resembles the hinges discussed and shown previously in most regards. Significantly, the integrated door stop features are hidden from view within the various knuckles of the hinge. The most significant difference in appearance is that the first knuckle 36 and the second knuckle 38 of the second hinge leaf 12 have an enlarged diameter or bulge compared with the hinges of previous Figures. There are multiple purposes for this enlargement. First, the bulge serves to preserve the life of a progressive die used to manufacture the second hinge leaf 12, as during manufacture the metal forming the second hinge leaf 12 need not be smashed thinner (or at least not nearly as much), but is instead deformed into a cavity. The deformation forming the buckle also makes the respective knuckles stronger. This change is most visible in FIGS. 19-22.

Another change that is not visible in the assembled hinge may be seen with reference to FIGS. 14-17 and 23. The first knuckle 22 of the first hinge leaf 10 is provided with an upper protrusion 82 that extends upward of the upper edge of the first knuckle 22 but inward of an outermost surface of the first knuckle 22. As may be seen in FIG. 14, the first knuckle 22 is the one that has the inner splined surface 28. As such, the first knuckle 22 is subject to additional forces each time the door stop features of the hinge are used, which forces may tend to cause the first knuckle 22 to tend to open over time, which could allow the hinge pin 42 to eventually slip and not provide the desired door stop features. As may be seen in FIG. 23, the head 56 of the hinge pin 23 in this embodiment is mushroom shaped and has a lower cavity 84 that accepts the upper protrusion 82 when the hinge pin 23 is fully inserted into the hinge. The engagement of the upper protrusion 82 with the lower cavity 84 provides additional security to the first knuckle 22 against unwanted opening of the first knuckle 22.

Figure 15:
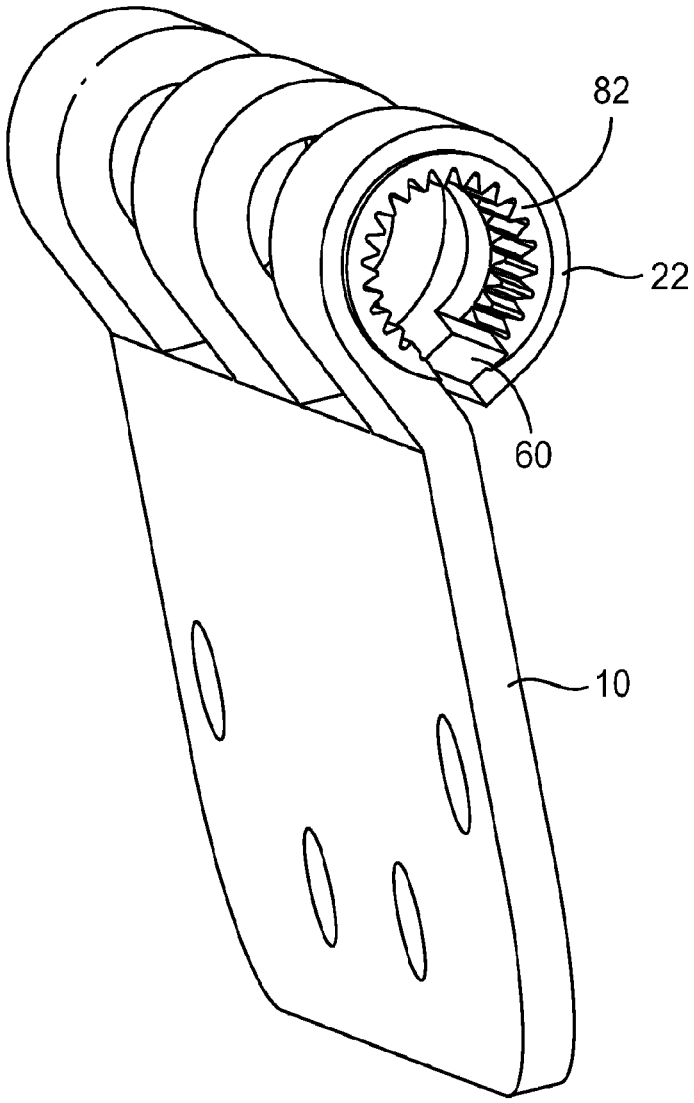

FIGS. 15-17 show perspective views of the first hinge leaf 10 looking approximately down and up through the hinge pin channel. The view of FIG. 15 shows the upper protrusion and the vertical channel 60 of the first knuckle 22. The view of FIG. 17 shows an optional feature that may be included in certain embodiments of the hinge for further security of engagement between the first hinge leaf 10 and the hinge pin 42, specifically the splined insert 80. The view of FIG. 16 shows the first hinge leaf 10 with the splined insert 80 removed from the second knuckle 24, illustrating a splined insert opening 86 configured to receive the splined insert 80. The splined insert 80 has a notch 88 and the splined insert opening 86 has a notch tab 90 to ensure proper alignment of the splined insert 80 within the splined insert opening 86 such that the fingers of the splined insert 80 align properly relative to the fingers of the splined opening 30 so that the hinge pin 42 can be properly inserted therein.

As may be appreciated from FIGS. 17 and 18, the splined insert 80 is a continuous element and is not a rolled element like the various knuckles. As such, the splined insert 80 is extremely resistant to undesired opening that could allow the fingers of the splined insert 80 to disengage from corresponding fingers on the lower splined portion 68 of the hinge pin 42. The splined insert 80 may be fixedly attached inside the splined insert opening 86 such as by welding, bonding, and the like. While the embodiment illustrated in FIGS. 13-23 includes the splined insert 80, other embodiments do not have the splined insert 80 but just the splined interaction between the first knuckle 22 and the hinge pin 42.

As may be seen in FIG. 18, the splined insert 80 has twenty-four fingers 92 that are equally spaced around the opening of the splined insert 80. This is intended to be exemplary only, but it will be readily appreciated that having this number of fingers 92 means that the door stop features of the hinge with respect to a single hinge pin 42 may be adjusted in increments of fifteen degrees (three hundred sixty degrees divided by twenty-four). Corresponding numbers of similar fingers are provided on the hinge pin 42 and the splined opening 30 (of course the total number of fingers in the splined opening 30 will be fewer, as there is a gap from the curling of the first knuckle 22 as well as an additional gap for the vertical channel 60). This may be sufficient adjustability in some instances. In other instances, it may be desired to have a finer adjustment capability than fifteen degrees. This finer adjustment may be achieved in one of several fashions. In one exemplary manner, finer adjustment may be achieved by increasing the number of fingers 92 (and decreasing their angular spacing). Thus, if thirty fingers 92 are provided, the door stop angle may be adjusted in twelve-degree increments. If thirty-six fingers 92 are provided, the door stop angle may be adjusted in ten-degree increments.

Depending on the materials used for the various components and any desired strength characteristics, there may be a practical limit on the number of fingers 92 that may be provided, and thus the minimum adjustment angle that can be achieved using a method relying on increasing the number of fingers 92. Instead, a different method may be used that relies on having multiple hinge pins 42, each with the relative rotational location of the fingers 92 rotated a certain amount with respect to the hinge pin stop element (e.g. the tabs 58). For example, returning to the example of FIG. 18, a single hinge pin 42 will allow stop adjustment in fifteen-degree increments. If two hinge pins 42 are provided, each having their respective fingers rotated at seven and one-half degrees differently compared to their respective tabs 58, then the stop of the hinge can be adjusted at seven and one-half degree increments by, in part, selecting which of the two hinge pins 42 to use. Similarly, adjustment in five-degree increments can be achieved in the system of FIG. 18 using three different hinge pins 42. In this fashion, any adjustment increment for the door stop features can be provided with multiple hinge pins 42. A system with multiple hinge pins 42 may be sold together, or individual hinge pins 42 may be sold separately.

Figure 21:
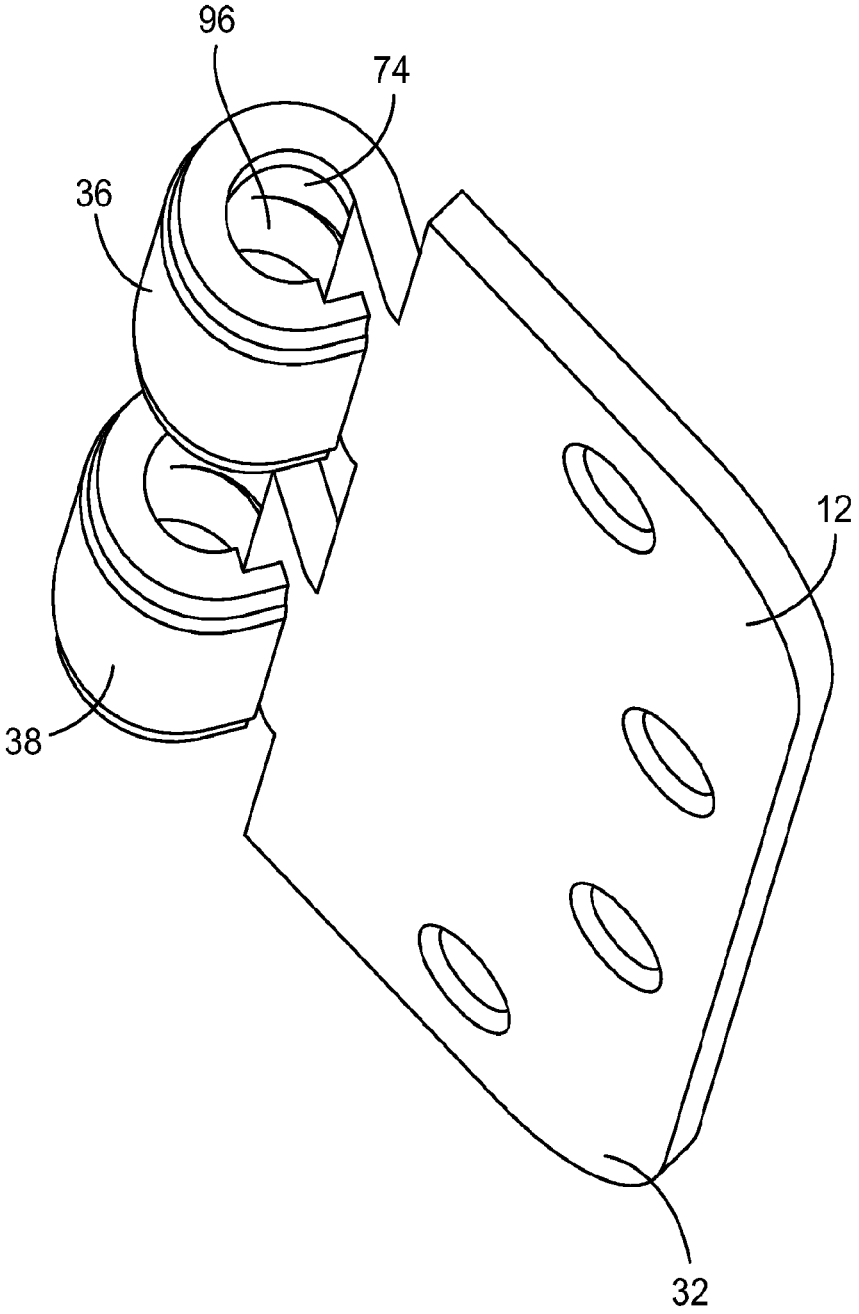
Figure 22:
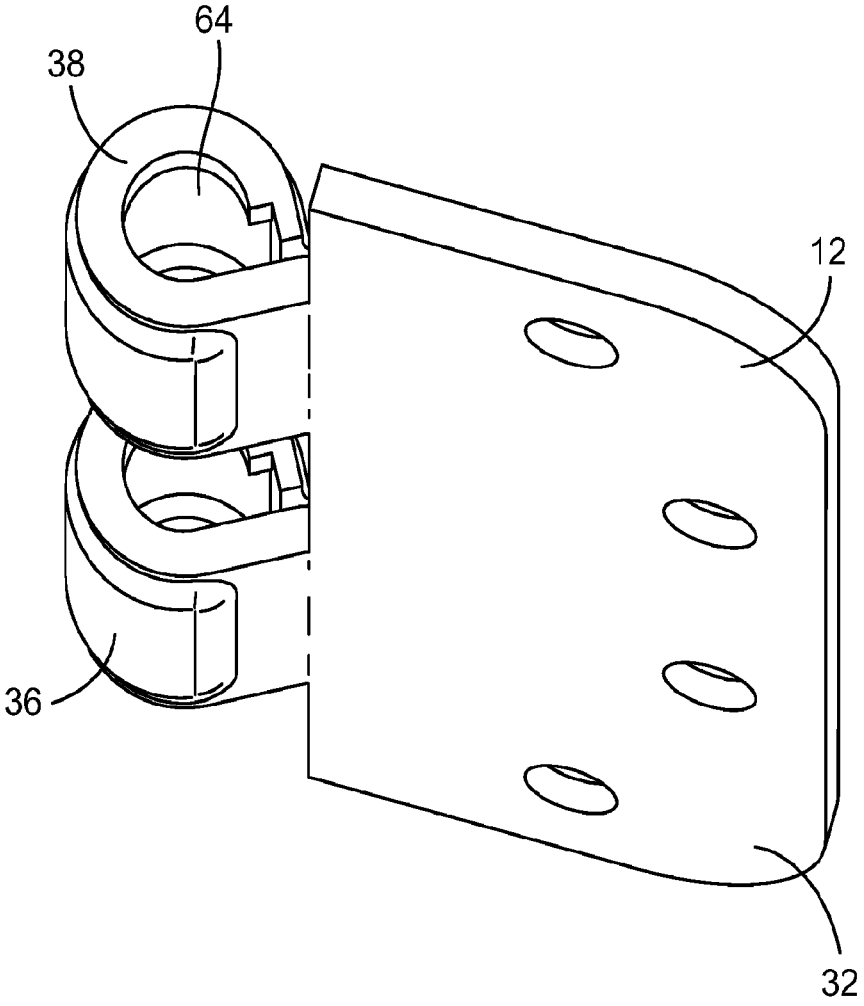

FIGS. 19-22 show the second hinge leaf 12 of this embodiment, showing how the first knuckle 36 and second knuckle 38 are bulged compared with previously-discussed embodiments. This provides certain potential advantages as discussed previously. The functionality of the hinge remains essentially unchanged when compared with the embodiments discussed previously. The view of FIG. 21 shows the unsloped portion 74, which, as discussed above, may assist in placement of the stop position. The hinge pin 42, as shown in FIG. 23 may then be tapped into final place, with sloped bottom portions 94 of the tabs 58 serving to facilitate movement of the tabs 58 over the portion having a varying depth 96 shown in FIG. 21.

Although not every element discussed with respect to FIGS. 1-12 has been discussed with respect to or specifically numbered in FIGS. 13-23, it is believed that the applicability of such features will be readily apparent from the study of this description and the accompanying Figures.

One contemplated benefit of the various embodiments of the present invention is the ease with which the embodiments of the invention may be manufactured and used. Essentially, the manufacturing processes currently used for manufacturing hinges need only be slightly modified to accommodate the invention. The stamping and knuckle-forming processes currently used to form hinges are acceptable to manufacture first hinge leaves 10 and second hinge leaves 12 in accordance with embodiments of the invention. A minor addition of steps may be used in some instances to incorporate the inner splined surface 28, to add the tabs 40, the circumferential channels 64, the vertical channels 60, the vertical channels 62, or any other knuckle stop elements or similar elements to those discussed herein. Hinge pins 42 in accordance with embodiments of the invention may be forged as are current hinge pins, with modified forging to incorporate the features discussed herein.

Another contemplated benefit is the fact that the hinge-integrated door stop is readily adjustable. Additionally, the adjustability is achieved without any need for modification or repair of an attachment point such as with prior door-, wall-, or floor-mounted door stops.

Another contemplated benefit is the fact that the door stop is entirely contained within the hinge, and is therefore essentially undifferentiated from prior hinges. The embodiments of the invention may therefore be used in a wide variety of situations, including situations where aesthetics of the hinge are of high importance. As the hinge-integrated door stop is located within the hinge, it also prevents any need to have external elements that are potential hazards and/or annoyances with respect to cleaning.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A hinge having a hinge-integrated stop comprising:

(a) a first hinge leaf comprising:

(1) a substantially-planar portion having a pivot edge and a top edge; and (2) a first knuckle extending from the pivot edge of the substantially-planar portion of the first hinge leaf near the top edge, the first knuckle comprising an inner splined surface and a vertical channel;

(b) a second hinge leaf comprising:

(1) a substantially-planar portion having a pivot edge; and (2) a first knuckle extending from the pivot edge of the substantially-planar portion of the second hinge leaf, the first knuckle comprising:

(A) a top portion having a first internal diameter and a vertical channel;

(B) a bottom portion having the first internal diameter; and (C) a first circumferential channel formed between the top and bottom portions, the first circumferential channel having an internal diameter that is greater than the first internal diameter, the first circumferential channel further having a side defined by a substantially-vertical edge; and (c) a hinge pin having a shaft, the shaft having a cylindrical shape defined by an outer diameter matching the first internal diameter, the shaft comprising:

(1) an upper splined portion having fingers extending beyond the outer diameter of the shaft, the upper splined portion configured to insert into the inner splined surface of the first knuckle of the first hinge leaf; and (2) a first tab extending outwardly from the outer diameter of the shaft, the first tab being positioned on the shaft at a longitudinal location that corresponds with the first circumferential channel of the first knuckle of the second hinge leaf such that the first tab is positioned within the first circumferential channel during operation of the hinge so that the first tab contacts the substantially-vertical edge of the first circumferential channel to restrict further rotation between the first and second hinge leaves.

2. A hinge as recited in claim 1, wherein:

the bottom portion of the first knuckle of the second hinge leaf also includes a vertical channel;

the first hinge leaf further comprises a second knuckle having a vertical channel; and the second hinge leaf further comprises:

a second knuckle extending from the pivot edge of the substantially-planar portion of the second hinge leaf, the second knuckle comprising:

(A) a top portion having the first internal diameter and a vertical channel;

(B) a bottom portion having the first internal diameter; and (C) a second circumferential channel formed between the top and bottom portions, the second circumferential channel having an internal diameter that is greater than the first internal diameter, the second circumferential channel further having a side defined by a substantially-vertical edge.

3. A hinge as recited in claim 2, wherein the hinge pin further comprises:

a second tab extending outwardly from the outer diameter of the shaft, the second tab being positioned on the shaft at a longitudinal location that corresponds with the second circumferential channel of the second knuckle of the second hinge leaf such that the second tab is positioned within the second circumferential channel during operation of the hinge so that the second tab contacts the substantially-vertical edge of the second circumferential channel to restrict further rotation between the first and second hinge leaves.

4. A hinge as recited in claim 3, wherein the substantially-vertical edge of the first and second circumferential channels are on the inner surface of the respective knuckle.

5. A hinge as recited in claim 1, wherein the first tab comprises a sloped lower edge.

6. A hinge as recited in claim 5, wherein at least one of the first or second circumferential channels comprises a varying internal diameter that is smaller proximate the substantially-vertical edge of the circumferential channel.

7. A hinge as recited in claim 6, wherein any circumferential channel comprising a varying internal diameter also comprises an un-sloped portion adjacent a portion comprising the varying internal diameter.

8. A hinge as recited in claim 1, wherein the hinge pin comprises a mushroom-shaped head defining a lower cavity configured to accept an upper protrusion of the first knuckle of the first hinge leaf when the hinge pin is in a position fully inserted into the hinge, thereby preventing unwanted opening of the first knuckle of the first hinge leaf.

9. A hinge as recited in claim 1, wherein the first hinge leaf comprises a second knuckle extending from the pivot edge of the substantially-planar portion of the first hinge leaf near a bottom edge of the first hinge leaf, the second knuckle comprising an inner splined surface defining a splined opening narrower than a splined opening defined by the inner splined surface of the first knuckle of the first hinge leaf, and wherein the shaft of the hinge pin comprises a lower splined portion longitudinally located on the shaft to correspond to the splined opening of the second knuckle of the first hinge leaf and having fingers extending no further than the shaft diameter.

10. A hinge as recited in claim 9, wherein the inner splined surface of the second knuckle of the first hinge leaf is formed by an insert inserted into the second knuckle.

11. A hinge as recited in claim 9, wherein when the hinge is assembled with the hinge pin passing through the first knuckle of the first hinge leaf, through the first knuckle of the second hinge leaf, and through the second knuckle of the first hinge leaf, the upper splined portion of the hinge pin is engaged with the inner splined surface of the first knuckle of the first hinge leaf and the lower splined portion of the hinge pin is engaged with the inner splined surface of the second knuckle of the first hinge leaf, thereby preventing rotation of the hinge pin with respect to the first hinge leaf.

12. A hinge as recited in claim 11, wherein a rotational location of the hinge pin with respect to the first hinge leaf dictates a stop position of the second hinge leaf with respect to the first hinge leaf.

13. A hinge having a hinge-integrated stop comprising:

(a) a first hinge leaf comprising:

(1) a substantially-planar portion having a pivot edge and a top edge; and (2) a first knuckle extending from the pivot edge of the substantially-planar portion of the first hinge leaf near the top edge, the first knuckle comprising an inner splined surface;

(3) a second knuckle extending from the of pivot edge of the substantially-planar portion of the first hinge leaf;

(b) a second hinge leaf comprising:

(1) a substantially-planar portion having a pivot edge; and (2) a first knuckle extending from the pivot edge of the substantially-planar portion of the second hinge leaf, the first knuckle comprising an inner surface and a first knuckle stop element on the inner surface of the first knuckle of the second hinge leaf, the first knuckle of the second hinge leaf being configured to be positioned between the first and second knuckle of the first hinge leaf; and (c) a hinge pin having a shaft, the shaft having a cylindrical shape define by an outer diameter, the shaft comprising:

(1) an upper splined portion having fingers extending beyond the outer diameter of the shaft, the upper splined portion configured to insert into the inner splined surface of the first knuckle of the first hinge leaf;

(2) a first shaft portion having a cylindrical shape defined by the outer diameter, the first shaft portion being positioned on the shaft at a longitudinal location that corresponds with the first knuckle of the first hinge leaf;

(3) a longitudinal channel extending along the length of the shaft, the longitudinal channel being defined by a first and a second side;

(4) a first circumferential channel that extends from the first side of the longitudinal channel around the shaft to a longitudinal edge, wherein the first circumferential channel is positioned on the shaft at a longitudinal location that corresponds with the first knuckle of the second hinge leaf such that the first knuckle stop element is positioned within the first circumferential channel during operation of the hinge so that the first knuckle stop element contacts the longitudinal edge of the first circumferential channel to restrict further rotation between the first and second hinge leaves; and (5) a second shaft portion having a cylindrical shape defined by the outer diameter, the second shaft portion being positioned on the shaft at a longitudinal location that corresponds with the second knuckle of the first hinge leaf such that the first circumferential channel is positioned between the first and second shaft portions.

14. A hinge as recited in claim 13, wherein the first and the second sides of the longitudinal channel extend outwardly to the outer diameter of the shaft.

15. A hinge as recited in claim 13, wherein the longitudinal edge extends outwardly to the outer diameter of the shaft.

16. A hinge as recited in claim 13, wherein the first and second knuckles of the first hinge leaf have an internal diameter that matches the external diameter of the shaft such that the first and second shaft portions are tightly contained within the first and second knuckles of the second hinge leaf.

17. A hinge as recited in claim 13, wherein the longitudinal channel extends from the first shaft portion through the first circumferential channel and the second shaft portion.

18. A hinge as recited in claim 13, wherein the second hinge leaf further comprises a second knuckle comprising an inner surface and a second knuckle stop element on the inner surface of the second knuckle of the second hinge leaf, and wherein the hinge pin further comprises:

a second circumferential channel that extends from the first side of the longitudinal channel around the shaft to a second longitudinal edge, wherein the second circumferential channel is positioned on the shaft at a longitudinal location that corresponds with the second knuckle of the second hinge leaf such that the second knuckle stop element is positioned within the second circumferential channel during operation of the hinge so that the second knuckle stop element contacts the second longitudinal edge of the second circumferential channel to restrict further rotation between the first and second hinge leaves.

19. A hinge as recited in claim 18, wherein:

the first hinge leaf further comprises a third knuckle extending from the pivot edge of the substantially-planar portion of the first hinge leaf, the second knuckle of the second hinge leaf being configured to be positioned between the second and third knuckles of the first hinge leaf; and the hinge pin further comprises a third shaft portion having a cylindrical shape defined by the outer diameter, the third shaft portion being positioned on the shaft at a longitudinal location that corresponds with the third knuckle of the first hinge leaf such that the second circumferential channel is positioned between the second and third shaft portions.

20. A hinge having a hinge-integrated stop comprising:

(a) a first hinge leaf comprising:

(1) a substantially-planar portion having a pivot edge and a top edge;

(2) a first knuckle extending from the pivot edge of the substantially-planar portion of the first hinge leaf near the top edge, the first knuckle comprising an inner splined surface and a vertical channel; and (3) a second knuckle extending from the pivot edge of the substantially-planar portion of the first hinge leaf, the first knuckle comprising a vertical channel;

(b) a second hinge leaf comprising:

(1) a substantially-planar portion having a pivot edge;

(2) a first knuckle extending from the pivot edge of the substantially-planar portion of the second hinge leaf, the first knuckle configured to be positioned between the first and second knuckles of the first hinge leaf when the hinge is assembled, the first knuckle comprising:

(A) a top portion having a first internal diameter and a vertical channel;

(B) a bottom portion having the first internal diameter and a vertical channel; and (C) a first circumferential channel formed between the top and bottom portions, the first circumferential channel having an internal diameter that is greater than the first internal diameter, the first circumferential channel further having a side defined by a substantially-vertical edge; and (3) a second knuckle extending from the pivot edge of the substantially-planar portion of the second hinge leaf, the second knuckle configured to be positioned below the second knuckle of the first hinge leaf when the hinge is assembled, the second knuckle comprising:

(A) a top portion having a first internal diameter and a vertical channel;

(B) a bottom portion having the first internal diameter; and (C) a second circumferential channel formed between the top and bottom portions, the second circumferential channel having an internal diameter that is greater than the first internal diameter, the second circumferential channel further having a side defined by a substantially-vertical edge; and (c) a hinge pin having a shaft, the shaft having a cylindrical shape defined by an outer diameter matching the first internal diameter, the shaft comprising:

(1) an upper splined portion having fingers extending beyond the outer diameter of the shaft, the upper splined portion configured to insert into the inner splined surface of the first knuckle of the first hinge leaf;

(2) a first tab extending outwardly from the outer diameter of the shaft, the first tab being positioned on the shaft at a longitudinal location that corresponds with the first circumferential channel of the first knuckle of the second hinge leaf such that the first tab is positioned within the first circumferential channel during operation of the hinge so that the first tab contacts the substantially-vertical edge of the first circumferential channel to restrict further rotation between the first and second hinge leaves; and (3) a second tab extending outwardly from the outer diameter of the shaft, the second tab being positioned on the shaft at a longitudinal location that corresponds with the second circumferential channel of the second knuckle of the second hinge leaf such that the second tab is positioned within the second circumferential channel during operation of the hinge so that the second tab contacts the substantially-vertical edge of the second circumferential channel to restrict further rotation between the first and second hinge leaves.

* * * * *